US009890562B2

(12) United States Patent
Kowalczyk

(10) Patent No.: US 9,890,562 B2
(45) Date of Patent: Feb. 13, 2018

(54) LOCKING ARRANGEMENT

(71) Applicant: Piotr Leonard Kowalczyk, Roodepoort (ZA)

(72) Inventor: Piotr Leonard Kowalczyk, Roodepoort (ZA)

(73) Assignee: Piotr Leonard Kowalczyk (ZA)

( * ) Notice: Subject to any disclaimer, the term of this patent is extended or adjusted under 35 U.S.C. 154(b) by 0 days.

(21) Appl. No.: 13/839,627

(22) Filed: Mar. 15, 2013

(65) Prior Publication Data

US 2013/0269403 A1 Oct. 17, 2013

(30) Foreign Application Priority Data

Mar. 20, 2012 (ZA) ..... 2012/02067

(51) Int. Cl.

| | |
|---|---|
| ***E05C 3/06*** | (2006.01) |
| ***E05C 3/16*** | (2006.01) |
| ***E05C 3/02*** | (2006.01) |
| ***E05C 3/04*** | (2006.01) |
| ***E05B 47/00*** | (2006.01) |
| ***E05B 47/06*** | (2006.01) |
| ***E05B 57/00*** | (2006.01) |

(Continued)

(52) U.S. Cl.

CPC ..... *E05B 47/0001* (2013.01); *E05B 47/0603* (2013.01); *E05B 57/00* (2013.01); *E05B 47/0004* (2013.01); *E05B 63/0065* (2013.01); *E05B 63/14* (2013.01); *E05C 7/00* (2013.01); *Y10T 70/7102* (2015.04); *Y10T 292/0945* (2015.04)

(58) Field of Classification Search

CPC ..... Y10T 292/1082; Y10T 292/1078; Y10T 292/1047; Y10T 292/1021; Y10T 292/0945; Y10T 70/7102; E05B 47/0001; E05B 47/0603; E05B 57/00; E05B 47/0004; E05B 63/0065; E05B 63/14; E05C 7/00

USPC ..... 292/216, 194, 195, 197, 198, 202, 203, 292/209, 210, 201

See application file for complete search history.

(56) References Cited

U.S. PATENT DOCUMENTS 212,487 A * 2/1879 Morris ..... E05B 65/0007 292/210

279,838 A * 6/1883 Sparks ..... E05B 5/00 292/200

(Continued)

*Primary Examiner* — Kristina R Fulton

*Assistant Examiner* — Faria F Ahmad

(74) *Attorney, Agent, or Firm* — Viksnins Harris Padys Malen LLP

(57) ABSTRACT

This invention relates to a locking arrangement 10 which includes a body 12 and a locking member 14 which is displaceable relative to the body 12. The locking member 14 defines at least one striker element engagement formation 18.1, 18.2 which is configured to engage a striker element 100 for part of its displacement relative to the locking arrangement 10 along a predetermined displacement path. The locking member 14 is displaceable between first and second spaced apart positions in each of which the engagement formation 18.1, 18.2 is positioned such that a said striker element 100 is releasably engageable therewith and between which a said striker element 100 is in engagement with the engagement formation 18.1, 18.2. The locking arrangement 10 further includes a securing mechanism 16 which is configured to secure the locking member 14 releasably in at least one of the first and second spaced apart positions.

18 Claims, 21 Drawing Sheets

(51) Int. Cl.

| | |
|---|---|
| *E05B 63/00* | (2006.01) |
| *E05B 63/14* | (2006.01) |
| *E05C 7/00* | (2006.01) |

(56) References Cited

U.S. PATENT DOCUMENTS 774,206 A * 11/1904 Seaman ..... E05C 5/00 211/4
916,446 A * 3/1909 Hunt ..... E05B 65/0007 292/194
917,379 A * 4/1909 Roy ..... E05C 5/00 292/210
917,664 A * 4/1909 Tayntor ..... E05B 85/24 16/49
930,534 A * 8/1909 Cox ..... E05C 3/24 292/198
1,036,347 A * 8/1912 Schmittberger ..... E05B 63/122 292/116
1,429,872 A * 9/1922 Hanson ..... B60J 1/2097 292/202
1,460,417 A * 7/1923 Hoff ..... E05F 11/00 292/202
3,596,959 A * 8/1971 Ferris ..... E05B 83/02 292/205
4,474,492 A * 10/1984 Fleitas ..... B62D 43/04 292/202
5,562,316 A * 10/1996 Bullock ..... E05B 83/10 292/202
6,062,613 A * 5/2000 Jung ..... E05B 81/06 292/201
6,106,033 A * 8/2000 Ruckert ..... 292/216
6,502,869 B1 * 1/2003 Rosenquist ..... E05C 3/00 292/202
6,502,871 B1 * 1/2003 Malmanger ..... E05C 3/042 292/163
6,523,868 B1 * 2/2003 Timothy ..... E05C 3/046 292/202
6,698,853 B2 * 3/2004 Chen ..... A47B 47/03 292/202
6,886,869 B2 * 5/2005 Martinez ..... E05B 17/0029 292/129
6,937,368 B2 * 8/2005 Liu ..... H04N 1/00925 292/101
6,945,585 B1 * 9/2005 Liu ..... B60N 2/01583 292/216
7,066,500 B2 * 6/2006 Haber ..... E05B 17/2038 292/106
7,070,578 B2 * 7/2006 Leukanech ..... A61M 1/0058 292/201
7,360,803 B2 * 4/2008 Parent ..... E05B 81/14 292/117
7,699,364 B2 * 4/2010 Tang ..... G06F 1/1616 292/210
7,926,858 B2 * 4/2011 Otsuka ..... B60N 2/01583 292/216
8,235,428 B2 * 8/2012 Hunt ..... E05B 85/26 292/216
8,516,864 B2 * 8/2013 Greiner ..... B62B 3/1404 292/201
8,672,368 B2 * 3/2014 Grosdemouge ..... E05B 81/14 292/201
2002/0089188 A1 * 7/2002 Edgar ..... E05B 85/243 292/216
2002/0101082 A1 * 8/2002 Schwaiger ..... E05B 83/16 292/216
2003/0020285 A1 * 1/2003 Kluting ..... E05B 77/02 292/216
2003/0080568 A1 * 5/2003 Busby ..... A47B 81/06 292/197
2003/0127866 A1 * 7/2003 Martinez ..... E05B 17/0029 292/216
2006/0055180 A1 * 3/2006 Kachouh ..... E05B 77/36 292/216
2006/0208502 A1 * 9/2006 Parent ..... E05B 81/14 292/216
2006/0208504 A1 * 9/2006 Kachouh ..... B60N 2/4435 292/216
2006/0267351 A1 * 11/2006 Spurr ..... E05B 81/20 292/216
2006/0279090 A1 * 12/2006 Ottino ..... E05B 85/26 292/216
2008/0111383 A1 * 5/2008 Van Ravenhorst ..... E05C 3/044 292/194
2010/0194120 A1 * 8/2010 Kaiser ..... E05B 81/20 292/198
2010/0308624 A1 * 12/2010 Juga ..... E05B 13/004 296/155
2011/0012376 A1 * 1/2011 Hunt ..... E05B 85/26 292/216
2011/0127780 A1 * 6/2011 Barth ..... E05B 85/243 292/213
2011/0187132 A1 * 8/2011 Scholz ..... E05B 81/20 292/226
2011/0204690 A1 * 8/2011 Torkowski ..... E05B 81/14 297/354.12
2011/0260475 A1 * 10/2011 Spurr ..... E05B 81/14 292/195
2012/0068479 A1 * 3/2012 Bendel ..... E05B 81/20 292/200
2012/0124911 A1 * 5/2012 Hagemeyer ..... E05C 17/50 49/394
2015/0225983 A1 * 8/2015 Alzingre ..... E05B 47/0005 292/143

* cited by examiner

LOCKING ARRANGEMENT

PRIORITY OF INVENTION

This application claims priority to South African Patent Application Number 2012/02067 that was filed on Mar. 20, 2012. The entire content of this application is hereby incorporated herein by reference.

FIELD OF INVENTION

This invention relates generally to a locking arrangement and an access control system.

BACKGROUND OF INVENTION

The Inventor is aware that current access control systems often make use of electro-magnetic locking arrangements for granting access to access-restricted areas (e.g. to control access to expensive equipment which needs to be protected against unauthorised access, e.g. by potential thieves). The disadvantage however of electro-magnetic locks are that they have to be powered all the time; draw large currents (i.e. up to 3 amps); are expensive; relatively difficult to install; and relatively heavy.

It is an object of this invention to provide means which the Inventor believes will at least alleviate some of the above identified problems.

SUMMARY OF INVENTION

In accordance with one aspect of the invention there is provided a locking arrangement which includes:

a body;

a locking member which is displaceable relative to the body, the locking member defining at least one striker element engagement formation which is configured to engage a striker element for part of its displacement relative to the locking arrangement along a predetermined displacement path, the locking member being displaceable between first and second spaced apart positions in each of which the engagement formation is positioned such that a said striker element is releasably engageable therewith and between which a said striker element is in engagement with the engagement formation; and a securing mechanism configured to secure the locking member releasably in at least one of the first and second spaced apart positions.

The locking member may be angularly displaceable relative to the body, and the at least one striker element engagement formation of the locking member may be configured to engage a striker element for part of its displacement along the predetermined displacement path, the locking member being angularly displaceable between the first and second positions, which are angularly spaced from each other, in each of which the engagement formation is positioned such that a said striker element is releasably engageable therewith and between which a said striker element is held captive in the engagement formation.

The locking member may be pivotally/rotationally connected to the body.

The locking member may include a first striker element engagement formation which is configured to engage a striker element for part of its displacement relative to the locking arrangement along a predetermined displacement path in a first displacement direction, wherein the locking member is configured to be displaced relative to the body, when the first engagement formation engages with the striker element and as the striker element is displaced relative to the locking arrangement further along the predetermined displacement path in the first displacement direction, away from its first position (hereinafter referred to as the "first locked position"), the locking member also including a second striker element engagement formation, which is either separate from, or forms part of, the first striker element engagement formation, the second engagement formation being configured to engage the striker element for part of its displacement relative to the locking arrangement along the predetermined displacement path in a second displacement direction, wherein the locking element is configured to be displaced relative to the body, when the second engagement formation engages with the striker element and as the striker element is displaced relative to locking arrangement further along the displacement path in the second displacement direction, away from its second position (hereinafter referred to as the "second locked position").

The first and second engagement formations may be oppositely disposed relative to each other.

The first and second striker element engagement formations may be oppositely disposed relative to each other.

The locking arrangement may include a locating/limiting mechanism which is engageable with the locking member, at least at some stage, during displacement of the locking member relative to the body in order to limit the amount of relative displacement between the locking member and the body. More specifically, the limiting mechanism may be configured to limit the amount of displacement of the locking member, relative to the body, away from its first locked position. The locking arrangement may include a shaft which is rotatably mounted to the body and to which the locking member is connected such that rotation of the shaft causes rotation of the locking member. The limiting mechanism may include a first limiting member which is rotatably fitted over the shaft and rotatable relative to the body, and a second limiting member which projects/protrudes radially outwardly from the shaft and which is engageable with the first limiting member, at least at some stage, during the displacement of the locking member between its first and second locked positions, in order to limit the amount of relative displacement between the locking member and the body. The limiting mechanism may include a securing element which is configured to secure and fix the first limiting member releasably relative to the body. The securing element may be a type of fastening means such as a screw. The second limiting member may include a stub formation.

The first limiting member may define a recess/cavity which extends along a circumference of the shaft and in which at least part of the second limiting member is located, the recess/cavity defining a path (hereinafter referred to as "path A") along which the at least part of the second limiting member is displaceable, when the shaft is rotated relative to the first limiting member. The cavity/recess may extend along a circumference of the shaft.

A limiting formation may be located at at least one end, preferably both ends, of path A, in order to limit the amount by which the second limiting member (and shaft) can be displaced along path A, by engaging with the second limiting member when it reaches the corresponding end of path A. The first limiting member may have an annular disk-shaped body which defines an inner, elongate cut-out which, when the first limiting member is fitted over the shaft, extends along a circumference of the shaft and defines path A.

The locking arrangement may include a securing mechanism which is configured to secure the locking member releasably in the first locked position and/or the second locked position. The securing mechanism may include a securing member which is displaceable relative to the locking member between a secured position where the securing member secures, or releasably secures, the locking member relative to the body in the first and/or second locked positions and an unsecured position where the locking member is allowed to be displaced relative to the body. More specifically, when the securing member is in its secured position, it may releasably secure the locking member relative to the body in the first locked position and/or the second locked position, and the securing mechanism may include a fixing member which is displaceable relative to the securing member between a fixed position wherein the fixing member fixes the securing member in its secured position and a free position wherein the securing member is allowed to be displaced to its unsecured position. More specifically, the fixing member may be displaceable into engagement with the securing member for fixing the securing member in its secured position, thereby locking the locking member in its first locked position and/or its second locked position; and out of engagement with the securing member for allowing the securing member to be displaced to its unsecured position. The fixing member may be connected to an actuator or displacement arrangement, which may include a solenoid, which is configured to displace the fixing member out of engagement with the securing member from its fixed position towards its free position. The fixing member may be connected to the actuator via a lever. The lever may be a first order lever, wherein the fixing member and actuator are connected to the lever on opposite sides of a pivotal connection via which the lever is connected to the body or part of the locking arrangement which is fixed relative to the body. The fixing member may therefore be connected to one end of the lever and the actuator may be connected to an opposite end of the lever. A displacement path (hereinafter referred to as "path B") of the fixing member as it is displaced into and out of engagement with the securing member may be substantially parallel to a displacement path (hereinafter referred to as "path C") of the actuator as it actuates and displaces the fixing member. The fixing member and an actuator arm of the actuator may be substantially of the same (or similar) weight. The fixing member may be a lock pin.

The securing member may be configured to engage with a corresponding third engagement formation of the locking member, when the securing member is in its secured position. The securing mechanism may include a biasing means which is configured to bias the securing member towards its secured position. The securing member, when in its secured position, may extend, at least partially, into a recess or opening provided by the third engagement formation, the securing member therefore engaging with a wall(s)/surface (s) of the third engagement formation defining the recess or opening, and wherein the locking arrangement may be configured such that when the locking member is in its first or second locked position, the securing member is in register with the recess or opening of the third engagement formation, thereby allowing the securing member to extend into the recess or opening in order to secure the locking member releasably in its first or second locked position.

The wall(s)/surface(s) of the third engagement formation defining the recess or opening may taper as it leads into the locking member such that when the securing member is in its secured position and a sufficient amount of force/torque is applied to the locking member away from the first or second locked position, relative to the body, the securing member is urged towards its unsecured position as a result of the force acting thereon by the wall(s)/surface(s), against the bias of the biasing means. Therefore, when the securing member is in its secured position, it releasably secures the locking member in its first and/or second locked position, however, once a sufficient amount of force or torque is applied to the locking member, the locking member can be displaced out of its first and/or second locked position. However, when the securing mechanism includes a fixing member, and the fixing member is in its fixed position, the locking member is fixed in its locked position (be it the first or second locked position) and a force/torque applied to the locking member will therefore not force the securing formation into its unsecured position.

The first engagement formation may be configured to be displaceable in a plane as the locking member is displaced towards, or away from, its first locked position, and the securing member may be configured to be displaceable relative to the locking member along a securing path, which is oriented transverse to the said plane, between its secured and unsecured positions. More specifically, the securing path may be oriented substantially perpendicular to the plane. Alternatively, the first engagement formation may be configured to be displaceable generally in a plane as the locking member is displaced towards, or away from, its first locked position, and the securing member may be configured to be displaceable relative to the locking member along a securing path, which is oriented substantially parallel to the said plane, between its secured and unsecured positions.

Preferably, the locking member may be displaceable between its first and second locked positions and the locking member may therefore the third engagement formation with which the securing member engages when the locking member is in its first locked position and the securing member is in its secured position; and a fourth engagement formation with which the securing member engages when the locking member is in its second locked position and the securing member is in its secured position. The fourth engagement formation may be similar to the third engagement formation and may therefore have a recess or opening into which the securing member extends, at least partially, when the locking member is in its second locked position and the securing member is in its secured position, thereby engaging with a wall(s)/surface(s) of the fourth engagement formation defining the recess or opening. The locking arrangement may be configured such that when the locking member is in its second locked position, the securing member is in register with the recess or opening of the fourth engagement formation, thereby allowing the securing member to extend into the recess or opening in order to secure the locking member releasably in its second locked position. The locking arrangement may, in this case, include an insert which is insertable into one of the recesses of the third or fourth engagement formation for inhibiting the securing member from extending into the particular recess and therefore inhibiting the securing formation from securing the locking member into the particular locked position, be it the first or second locked position.

The locking member may include a first locking member element which defines the third and/or fourth engagement formations; and a second locking member element, which is connected to, but spaced from, the first locking member element, and which defines the first and second engagement formations. The first and second locking member elements may be interconnected by means of a shaft such that rotation of the shaft causes both locking member elements to rotate, the locking member elements therefore being angularly/rotationally displaceable relative to the body about an axis of rotation defined by the shaft.

The locking arrangement may be configured to engage with a second striker element to thereby create a type of dual-locking arrangement. The locking member may therefore include a third locking member element, which is configured in a similar fashion to the second locking member element, the third locking member element therefore including two engagement formations, namely a fourth and fifth engagement formation, which are configured to engage with a second striker element in a similar fashion to the first and second engagement formations located on the second locking member element. The third locking member element may be connected to the first and second locking member elements by means of the shaft.

In an alternative embodiment, the locking member may be slidably displaceable relative to the body, towards and away from, a first locked position. The locking member may be biased by a biasing means towards its first locked position. When in the first locked position, the first and/or second engagement formations of the locking member may be positioned in the displacement path (i.e. the relative displacement path between the locking arrangement and the striker element) and may therefore be configured to engage, at some stage, with a striker element when, in use, the locking arrangement and striker element are displaced relative to each other along the displacement path. When the striker element engages with the first or second engagement formation and is displaced further along the displacement path, the locking member is urged/forced, against the bias of the biasing means, away from its first locked position to thereby allow the striker element to pass. Once passed, the biasing means will return the locking member to its first locked position.

In accordance with another aspect of the invention there is provided a lock installation which includes:

a support structure which defines an access opening through which access is in use granted to an access-restricted enclosure;

a door which is displaceably mounted to the support structure and which is displaceable between a closed position in which the door closes off the access opening in order to prohibit access to the access-restricted enclosure, and an open position where the access opening is not closed off by the door, thereby providing access to the access-restricted enclosure through the access opening;

a locking arrangement which is mounted to one of the door and the support member; and a striker element which is mounted to the other of the door and the support member, the locking arrangement and striker element therefore being displaceable relative to each other along a predetermined displacement path when the door is displaced between its open and its closed positions, wherein the locking arrangement includes a body, a locking member which is displaceable relative to the body, the locking member defining at least one striker element engagement formation which is configured to engage the striker element for part of its displacement along the predetermined displacement path as the door is displaced relative to the support structure, the locking member being displaceable between first and second spaced apart positions in each of which the engagement formation is positioned such that the striker element is releasably engageable therewith and between which the striker element is in engagement with the engagement formation, and a securing mechanism configured to secure the locking member releasably in at least one of the first and second spaced apart positions.

The locking member may be configured to allow the striker element to be spaced from, and therefore not in constant engagement with, the striker element engagement formation, when the locking member is in its first and/or second positions. The striker element may be displaceable between two extremities along its predetermined displacement path and the locking member may be configured to allow the striker element to be spaced from the striker element engagement formation when in one of its two extremities and only to engage with the striker element engagement formation when the striker element is displaced between its two extremities.

The locking arrangement may be a locking arrangement as defined above.

In accordance with a further aspect of the invention there is provided an access control system which includes:

a locking arrangement as defined above; and a control unit which is connected to the locking arrangement and which is configured to receive an input from a user; determine whether, based on the input received from the user, access may be granted; and if so, to grant access by communicating with the locking arrangement to allow the locking member to be displaced, relative to the body of the locking arrangement, away from its first locked position.

More specifically, the control unit may be configured to communicate with the actuator or displacement arrangement of the locking arrangement for displacing the lock pin out of engagement with the securing member, when access is granted.

BRIEF DESCRIPTION OF THE DRAWINGS

The invention will now be described, by way of example, with reference to the accompanying diagrammatic drawings. In the drawings.

DETAILED DESCRIPTION OF PREFERRED EMBODIMENT

Figure 1:
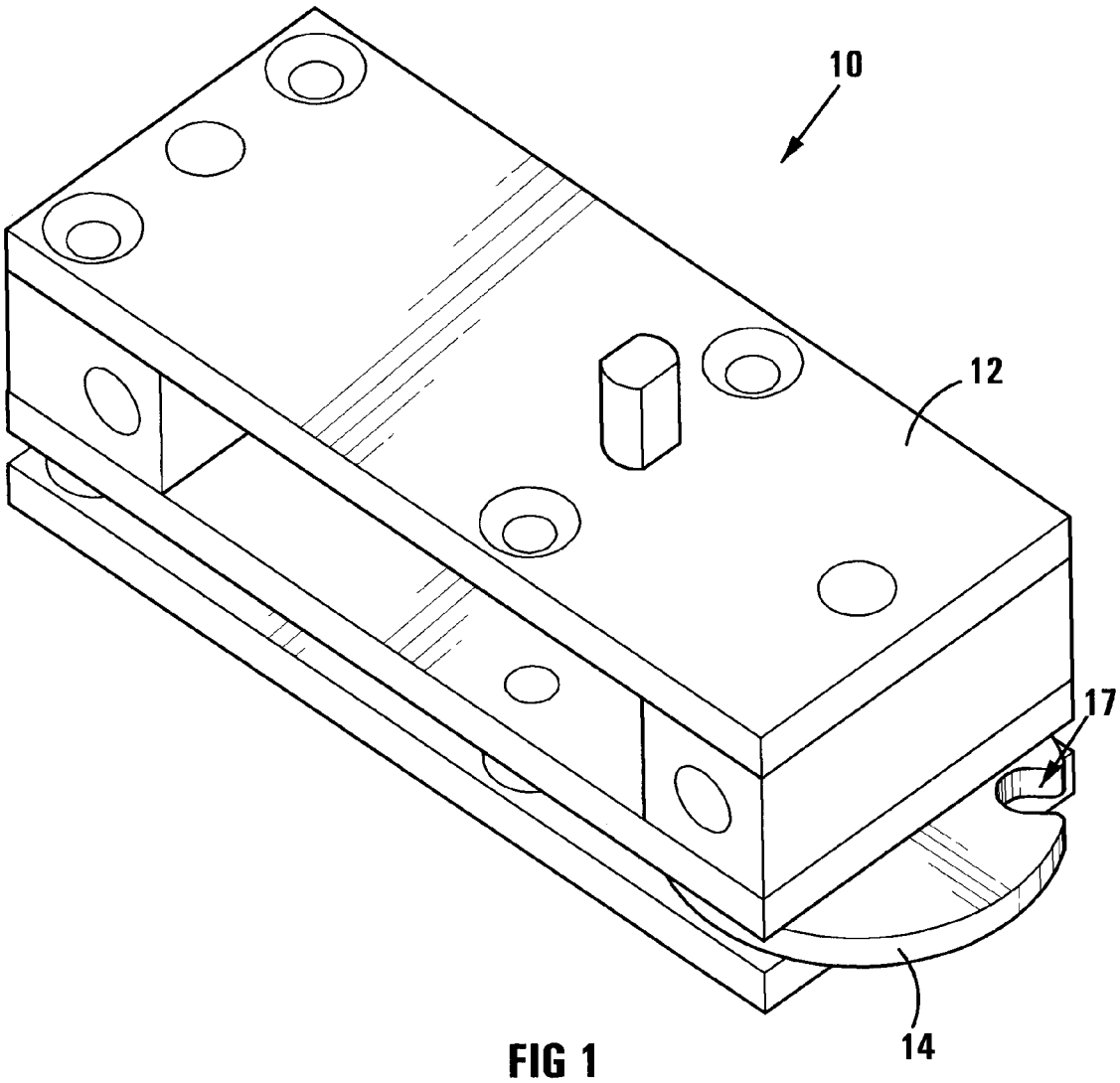
FIG. 1 shows a three-dimensional view of a locking arrangement in accordance with the invention.
Figure 2:
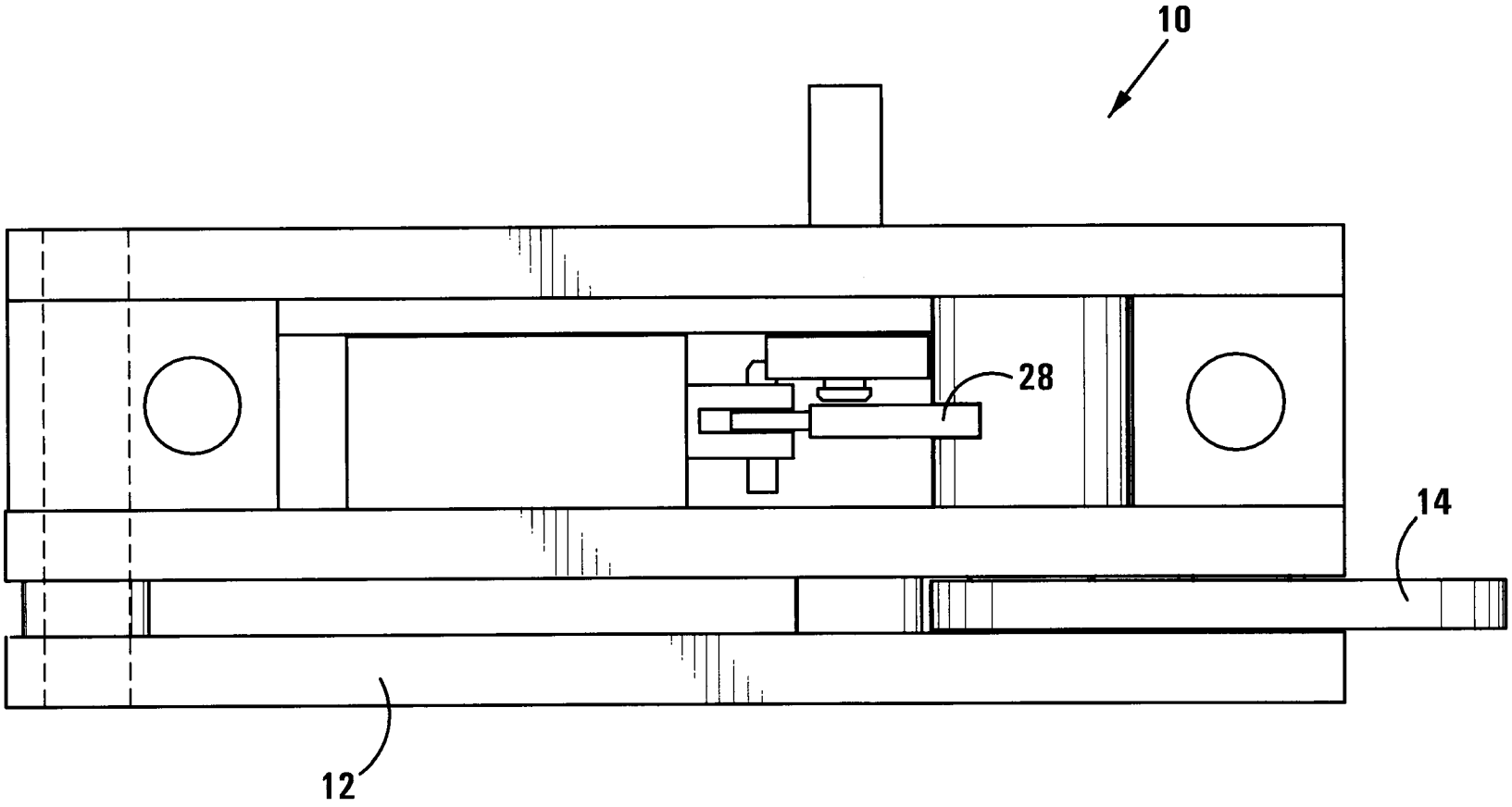
FIG. 2 shows a side view of the locking arrangement of FIG. 1.

In the drawings reference numeral 10 refers generally to a locking arrangement in accordance with the invention.

The locking arrangement 10 includes a body 12, a locking member 14, which is rotationally mounted to the body 12; and a securing mechanism 16.

The locking member 14 is rotationally mounted onto the body 12 by means of a shaft 15 and bearing arrangement generally indicated by reference numeral 13 (the bearing arrangement is not illustrated in detail). The locking member 14 defines a recess or cut-out 17 (see FIG. 4). Sides 19.1, 19.2 of the locking member 14 forming the recess 17 form first and second engagement formations 18.1, 18.2, respectively, which, in use, engage with a striker element 100. The engagement with the striker element 100 will however be discussed in more detail below. Locking member 14 includes third and fourth engagement formations 23.1, 23.2. Each engagement formation 23.1, 23.2 defines a recess 20.1, 20.2, with walls or surfaces 21.1, 21.2 of the locking member 14 defining the recesses 20.1, 20.2 tapering inwardly as they lead into the locking member 14. The locking arrangement 10 also includes a complementary insert 24 (see FIG. 4) which is receivable in either recess 20.1, 20.2. The locking member 14 is rotatable relative to the body 12 about an axis of rotation 110. The third and fourth engagement formations 20.1, 20.2 are at an equal radial spacing from the axis 110 and are accordingly angularly displaceable along a circular path about the axis 110.

Figure 3:
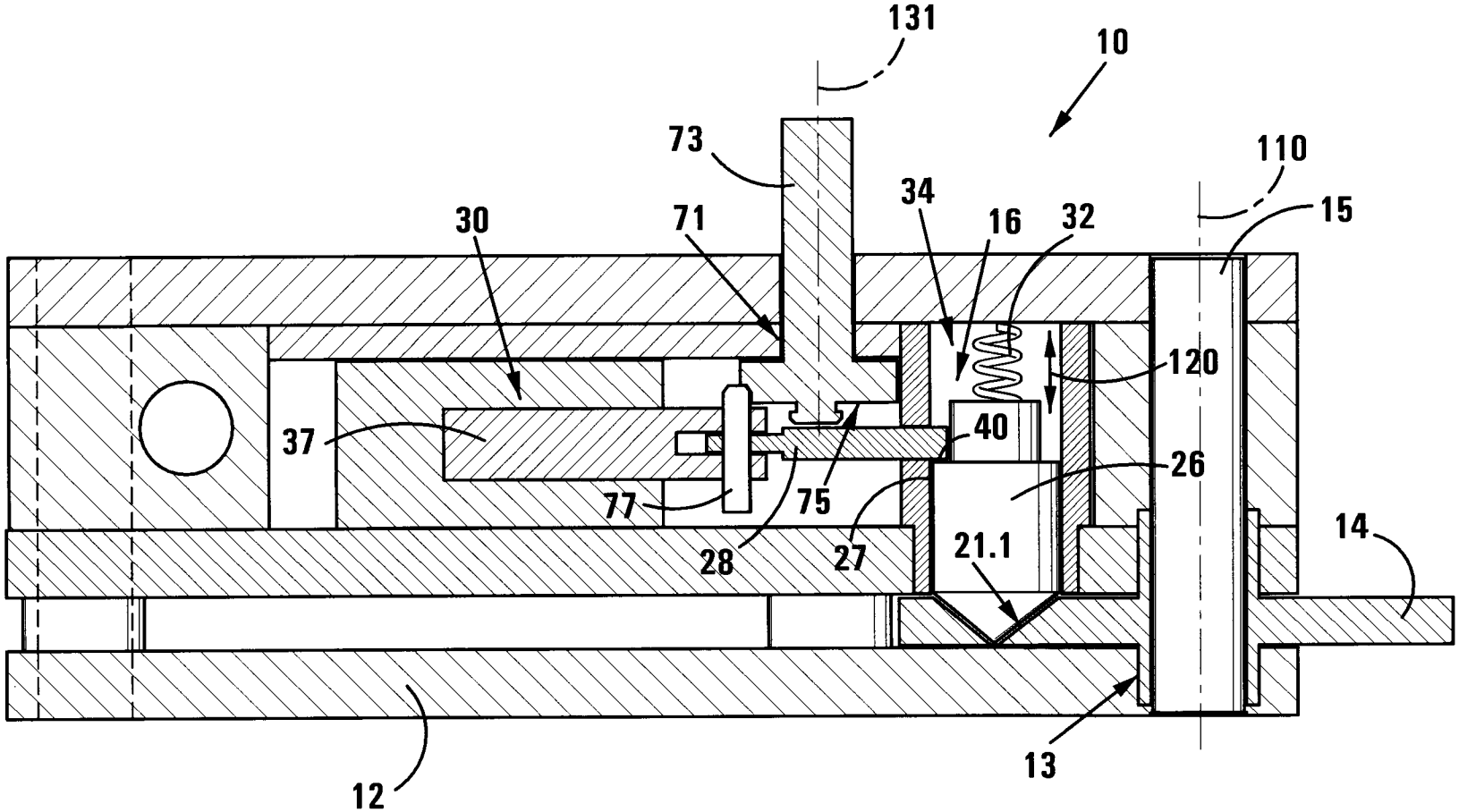
FIG. 3 shows a sectional side view of the locking arrangement of FIG. 1.
Figure 5:
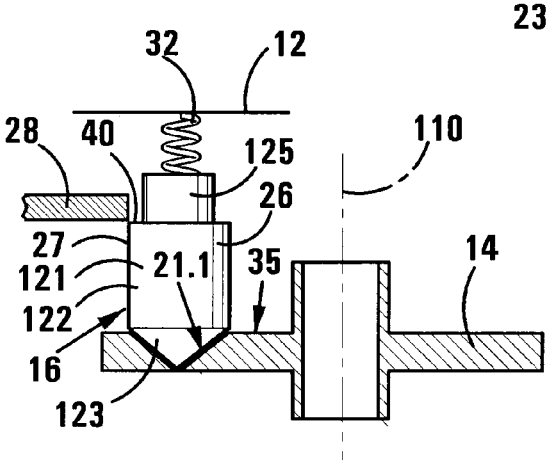
FIG. 5 shows a sectional side view of part of the locking arrangement of FIG. 1, where a securing member of a securing mechanism of the locking arrangement is in a secured position and a lock-pin of the securing mechanism is in a free position.

The securing mechanism 16 includes a securing member 26, a fixing member in the form of an elongate lock pin 28, a displacement arrangement 30 and a biasing means 32. The securing member 26 has body 121 which can generally be divided into a circular cylindrical main body portion 122; a circular cylindrical operatively upper portion 125 which protrudes from an end of, and has a smaller diameter than, the main body portion 122; and an operatively lower portion 123 (see FIG. 5) which protrudes from the lower end of the main body portion 122. The operatively lower portion 123 of the body 121 tapers from the main body portion 122 into a downwardly projecting point. Due to the difference in diameter between the operatively upper portion 125 and the main body portion, 122, the body 121 defines an annular flange or shoulder 40. The body 12 defines a channel 34 within which the securing member 26 is positioned (see FIG. 3). The securing member 26 is displaceable relative to the body 12 and locking member 14 along a securing path in the channel 34 which is generally parallel to the axis 110 in the direction of arrows 120. The securing member 26 is positioned above the locking member 14 such that when the locking member 14 is rotated about the axis 110, the recesses 20.1, 20.2 of the third and fourth engagement formations 23.1, 23.2 will, at some stage, come into register, or in line, with the securing member 26. The securing member 26 is biased by the biasing means 32 (which may be in the form of a spring) towards the locking member 14. Therefore, when the securing member 26 is in register with the recesses 20.1, 20.2 of the third or fourth engagement formations 23.1, 23.2, the biasing means 32 will urge the securing member 26 to extend into the recesses 20.1, 20.2 (more particularly the operatively lower portion 123 of the body 121 of the securing member 26), thereby inhibiting further rotation of the locking member 14 about the axis 110.

Figure 6:
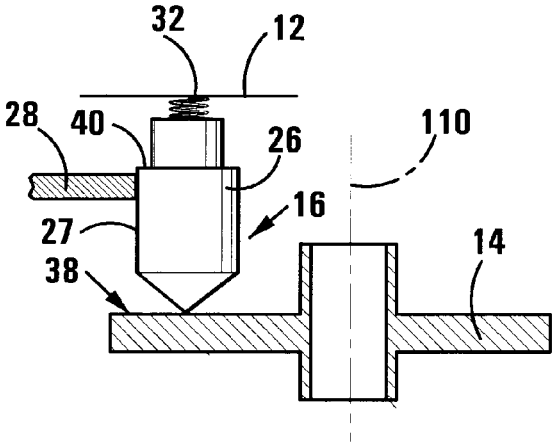
FIG. 6 shows a sectional side view of part of the locking arrangement of FIG. 1 (similar to FIG. 5), with the securing member in an unsecured position.

The securing member 26 is therefore displaceable along the channel 34 between an unsecured position (shown in FIG. 6) where the securing member 26 merely abuts an upper surface 38 of the locking member 14 and allows the locking member 14 to be rotated about the axis 110; and a secured position (shown in FIGS. 3 and 5) where the locking member 26 extends into one of the recesses 20.1, 20.2 of the third or fourth engagement formations 20.1, 20.2, thereby inhibiting rotation of the locking member 14 about the axis 110. The securing member 26 is therefore configured to secure the locking member 14 releasably into either a first locked position (see FIG. 8) where the securing member 26 extends into the recess 20.1 of the third engagement formation 23.1; or a second locked position (see FIG. 9) where the securing member 26 extends into the recess 20.2 of the fourth engagement arrangement 23.2 (the fact that the locking member 14 is only releasably secured in one of its locked positions by the securing member 26 will be explained below).

The tapered surfaces 21.1, 21.2 of the locking member 14 defining the recesses 20.1, 20.2 of the third and fourth engagement formations 23.1, 23.2 and a complementary tapered surface of the operatively lower portion 123 of the securing member 26 function as a detent or cam arrangement. Accordingly, when a sufficient amount of angular force or torque is applied to the locking member 14, relative to the body 12 (about the axis 110), the securing member 26 is urged upwards towards its unsecured position, against the bias of the biasing means 32, due to the force(s) acting thereon by the tapered surfaces 21.1, 21.2 in the manner of a cam and follower. The securing member 26 therefore only releasably secures the locking member 14 into its first and second locked positions.

The lock pin 28 is displaceable into and out of engagement with the shoulder 40 of the securing member 26. More specifically, when the securing member 26 is in its unsecured position (see FIGS. 6 and 7), an end portion of the lock pin 28 abuts a side 27 of the main body portion 122 of the securing member 26 and is therefore disengaged from the shoulder 40. However, when the securing member is in its secured position (see FIGS. 3 and 5), the lock pin 28 can be slid into engagement with the shoulder 40, thereby inhibiting the securing member 26 from being displaced towards its unsecured position when an angular force or torque is applied to the locking member 14. The lock pin 28 is therefore displaceable relative to the securing member 26 between a fixed or locked position (see FIG. 3) where the lock pin 28 engages with the shoulder 40 of the securing member 26 and a free or unlocked position where the lock pin 28 is disengaged from the shoulder 40 (see FIGS. 5 to 7). The lock pin 28 is displaceable between its two positions by means of an actuator or displacement arrangement 30, which in this example includes a solenoid 37, to which it is connected. More specifically, the lock pin 28 is longitudinally aligned with an actuating/displacement path of the actuator or displacement arrangement 30. The solenoid 37 only requires about 300 mA to be operated and is controlled by a control unit which will be described in more detail below. Therefore, although the securing member 26, along with the biasing means 32, only releasably secures the locking member 14 into one of its two locked positions, the lock pin 28 can fix the securing member 14 into its secured position, thereby fixing or locking the locking member 14 into one of its locked positions. In this example, the locking arrangement 10 also includes a manual/mechanical override mechanism 71 which is also configured to displace the lock pin 28 between its two positions. The override mechanism 71 includes a stem 73 which is rotatable about an axis of rotation 131. An end portion 75 of the stem 73 is configured to engage with a transverse rod 77 which is in turn connected to the lock pin 28, such that the lock pin 28 is displaceable between its two positions upon rotation of the stem 73. Although not specifically shown, the override mechanism 71 may include a key formation for receiving a key, wherein the key formation is configured to inhibit rotation of the stem 73 unless an appropriate key is inserted into the key formation.

Figure 8:
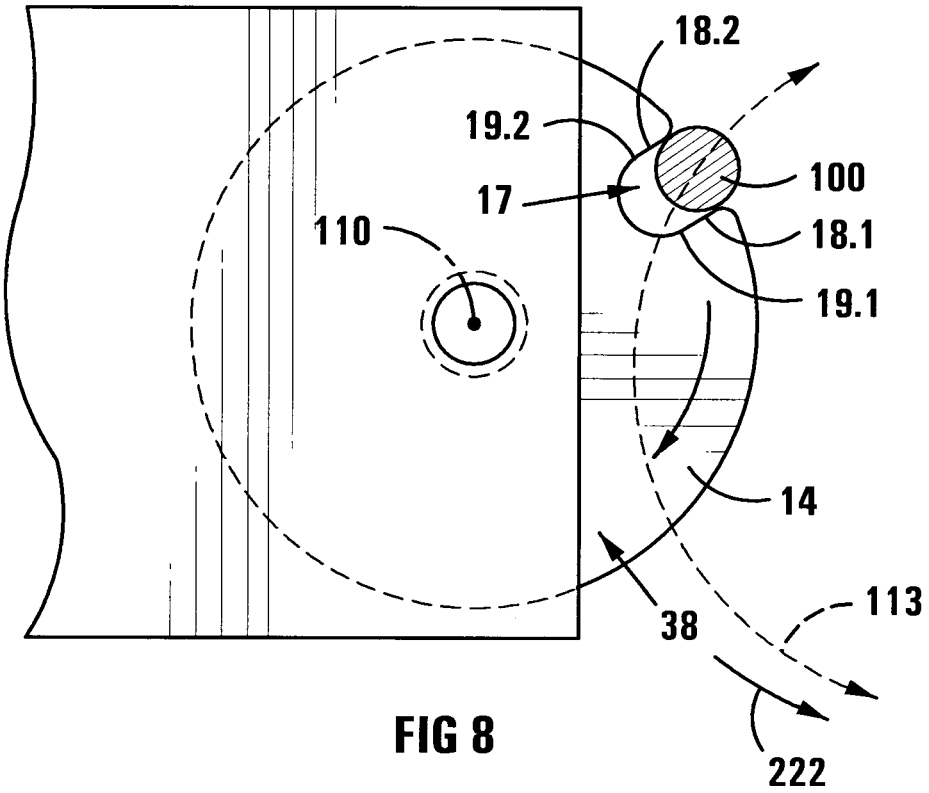
FIG. 8 shows a schematic top view of the locking arrangement of FIG. 1, when in use, where a locking member of the locking arrangement is in a first locked position.
Figure 9:
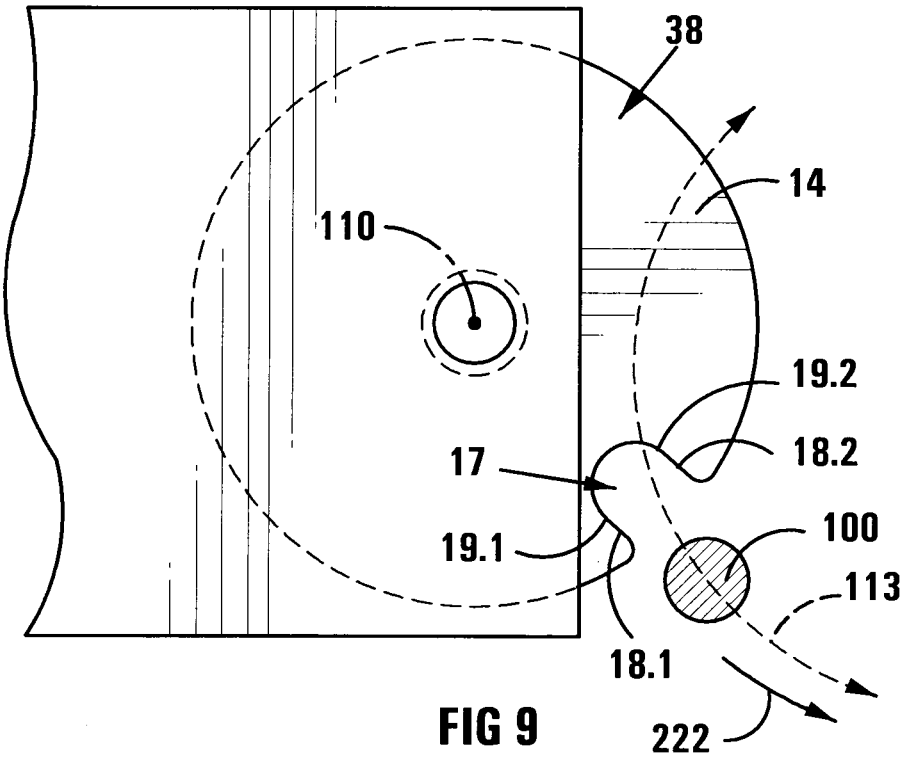
FIG. 9 shows a schematic top view of the locking arrangement of FIG. 1, when in use, where a locking member of the locking arrangement is in a second locked position.
Figure 10:
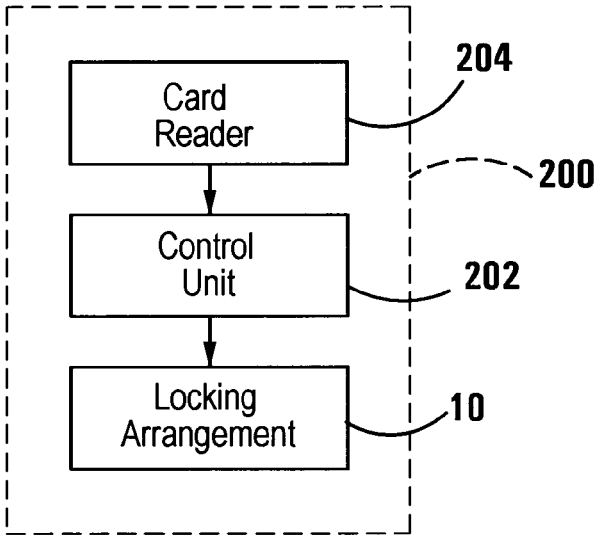
FIG. 10 shows a schematic lay-out of an access control system in accordance with the invention.

In use, the locking arrangement 10 may form part of an access control system 200 (see FIG. 10) for restricting access to an access-restricted area. The system 200 includes a lock installation which includes the locking arrangement 10 which is mounted to a door frame (not shown); and a corresponding striker element 100 (see FIGS. 8 and 9) which is mounted to, or forms part of, a corresponding door which is hingedly or slidably connected to the door frame (not specifically shown). The system further includes a control unit 202 which is configured to actuate the actuator or displacement arrangement 30; and a user input arrangement such as a card reader 204 which is connected to the control unit 202 (in an alternative embodiment, the locking arrangement 10 may be mounted to the door and the striker element 100 can be mounted to the door frame). The striker element 100 is displaceable relative to the locking arrangement 10 along a displacement path 113 (or vice versa) between two extremities, e.g. a closed position (see FIG. 8) and an open position (see FIG. 9), and the striker element 100 is receivable within the recess 17 of the locking member 14 for displacement of the striker element 100 between its two extremities. In both extremities (i.e. the closed and open positions), the striker element 100 is spaced from the recess 17, i.e. the locking member 14 is not in constant engagement with the striker element 100 during use, but only engages therewith when the striker element 100 is displaced along its displacement path 113 between its two extremities. The locking arrangement 10 therefore does not physically lock the striker element 100 in its closed and open positions but merely allows or prevents the displacement of the striker element 100 between its two positions. As shown in FIG. 8, the locking member 14 may be positioned in the first locked position, with the securing member 26 in its secured position and the lock pin 28 in its fixed position. In this configuration, the first engagement formation 18.1 inhibits the striker element 100, and therefore the door, from being displaced in a first displacement direction 222 along the displacement path 113.

Figure 11:
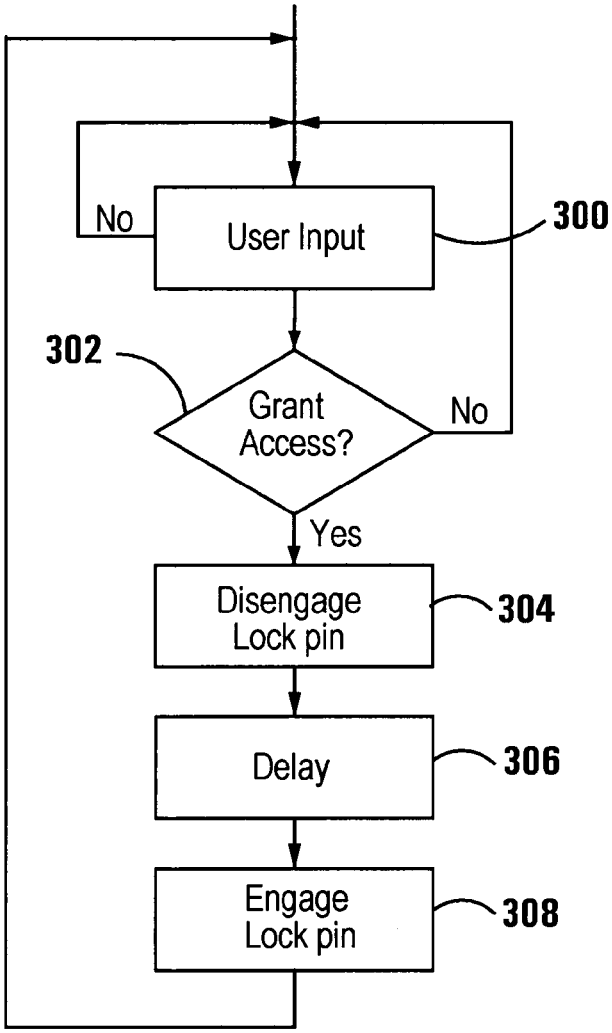
FIG. 11 shows a flow diagram of the access control system of FIG. 10.

The card reader 204 is configured to read identification cards of users and to send the details thereof to the control unit 202 (see FIG. 11, block 300). Upon receipt of the details the control unit 202 determines whether or not access may be granted (see FIG. 11, block 302). If access is granted, the control unit 202 instructs the displacement arrangement 30 to displace the lock pin 28 into its free position (see FIG. 11, block 304) for a certain predetermined time period (e.g. 5 seconds) (see FIG. 11, block 306) whereafter the displacement arrangement 30 will again be instructed by the control unit 202 to displace the lock pin 28 towards its fixed position (see FIG. 11, block 308). When a user, within the said period, then applies a sufficient amount of force/torque on the striker element 100, e.g. by pushing on the door, to move it in the first displacement direction 222, the striker element 100 will engage with the first engagement formation 18.1 and transfer the force/torque to the locking member 14, thereby displacing the securing member 26 upwards against the bias of the biasing means 32 towards its unsecured position, thereby allowing the locking member 14 to be displaced from its first locked position shown in FIG. 8 towards its second locked position shown in FIG. 9. When the locking member 14 has been displaced into its second locked position, the securing member 26 is again displaced towards its secured position (i.e. into the recess 20.2) and the lock pin 28 is displaced into its fixed position (after the time delay), thereby locking the locking member 14 into its second locked position.

Similarly, when the user wants to exit the restricted access area, the lock pin 28 may be disengaged from the securing member 26 via another card reader (not shown) which is positioned inside the access restricted area. With the lock pin 28 in its free position, the user may again push the door (in the opposite direction) which will cause the striker element 100 to engage with the second engagement formation 19.2, thereby displacing the locking member 14 towards its first locked position.

The locking arrangement 10 need not necessarily form part of a sophisticated access control system 200 but may also be operated by a simple switch.

Figure 7:
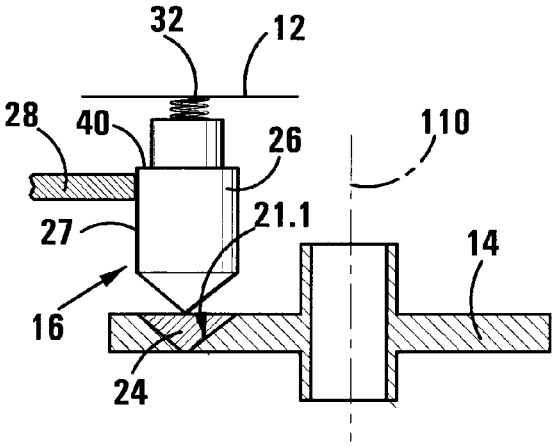
FIG. 7 shows a sectional side view of the locking arrangement of FIG. 1 (similar to FIG. 5), with the securing member in an unsecured position and where the insert shown in FIG. 4 is inserted into a recess provided in the locking member.

By inserting an insert 24 into one of the recesses 20.1, 20.2 of the third or fourth engagement formations 23.1, 23.2, the locking arrangement 10 can be configured to be lockable in only one position, i.e. by inhibiting the securing member 26 from extending into a particular recess 20.1, 20.2 of one of the engagement formations 23.1, 23.2, the locking member 14 is inhibited from being locked into one of the two locked positions (see FIG. 7). In an alternative embodiment, where a locking arrangement 100 with only one lockable position is required, the locking member 14 may include only a third (and not a fourth) engagement formation 23.1 (and recess 20.1).

If the locking member 14 constantly engages with the striker element 100, forces acting on the locking member by the striker element 100 (e.g. as a result of a door seal or a person pressing on the door) may end up being transferred to the securing member 26 which in turn may press against the lock pin 28. The lock pin 28 may therefore as a result require more force to be operated in order to disengage from the securing member 26, which would mean the use of a larger solenoid (which will draw larger current).

However, by using the locking arrangement 10 set out above, this problem is alleviated by the fact that the striker element 100 is disengaged from the locking member 14 when in its closed or open position. The lock pin 28 will therefore require less force to be operated which, in turn, means the use of a smaller solenoid.

FIGS. 12 to 21 illustrate alternative embodiments of the locking member 14 and, unless otherwise indicated, the same reference numerals used in FIGS. 1 to 9 will be used to designate similar components in FIGS. 12 to 21.

Figure 12:
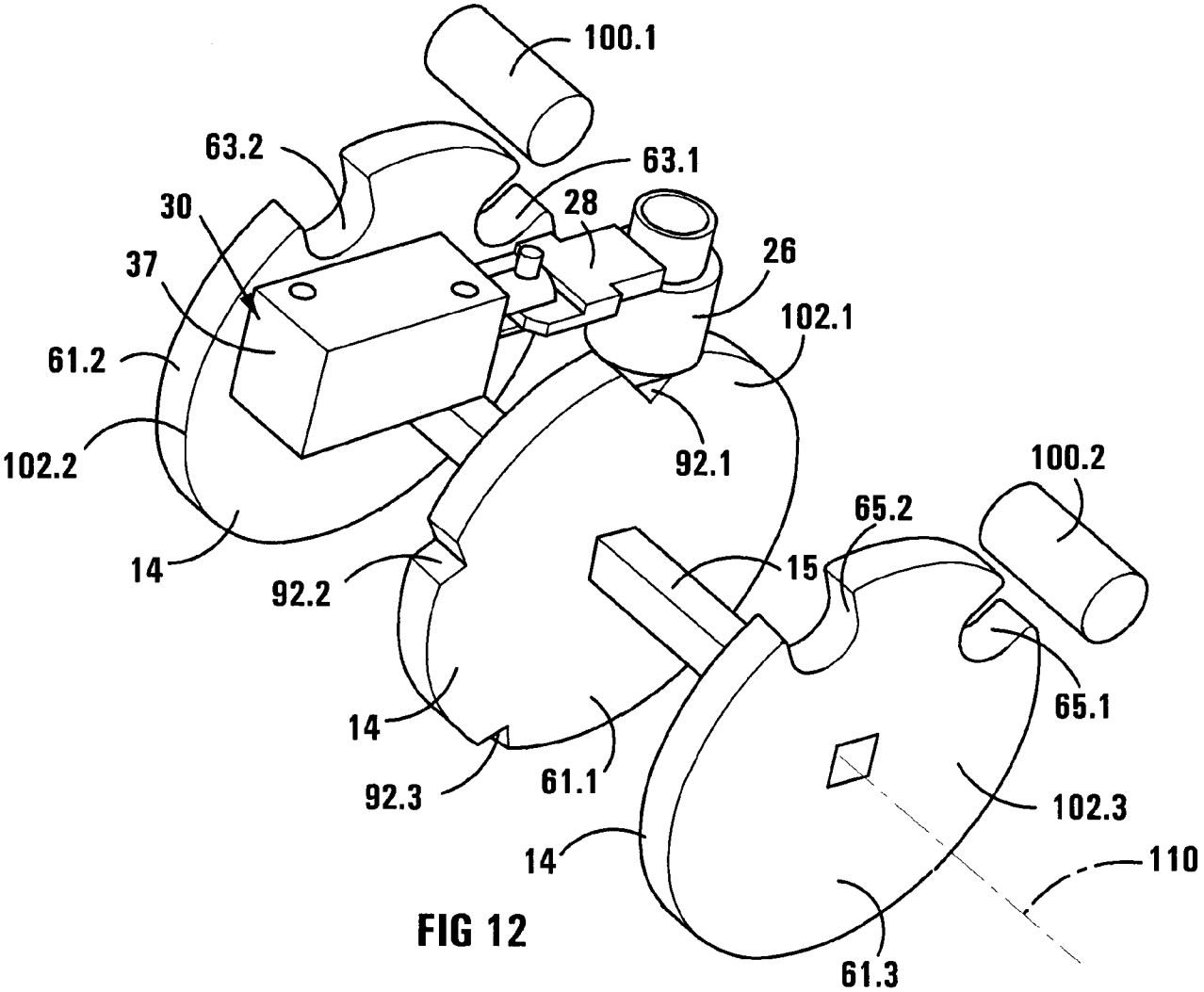
FIG. 12 shows a three-dimensional view of part of the locking arrangement of FIG. 1, when in use, where the locking arrangement has a dual locking member, with both striker elements in respective closed positions.
Figure 13:
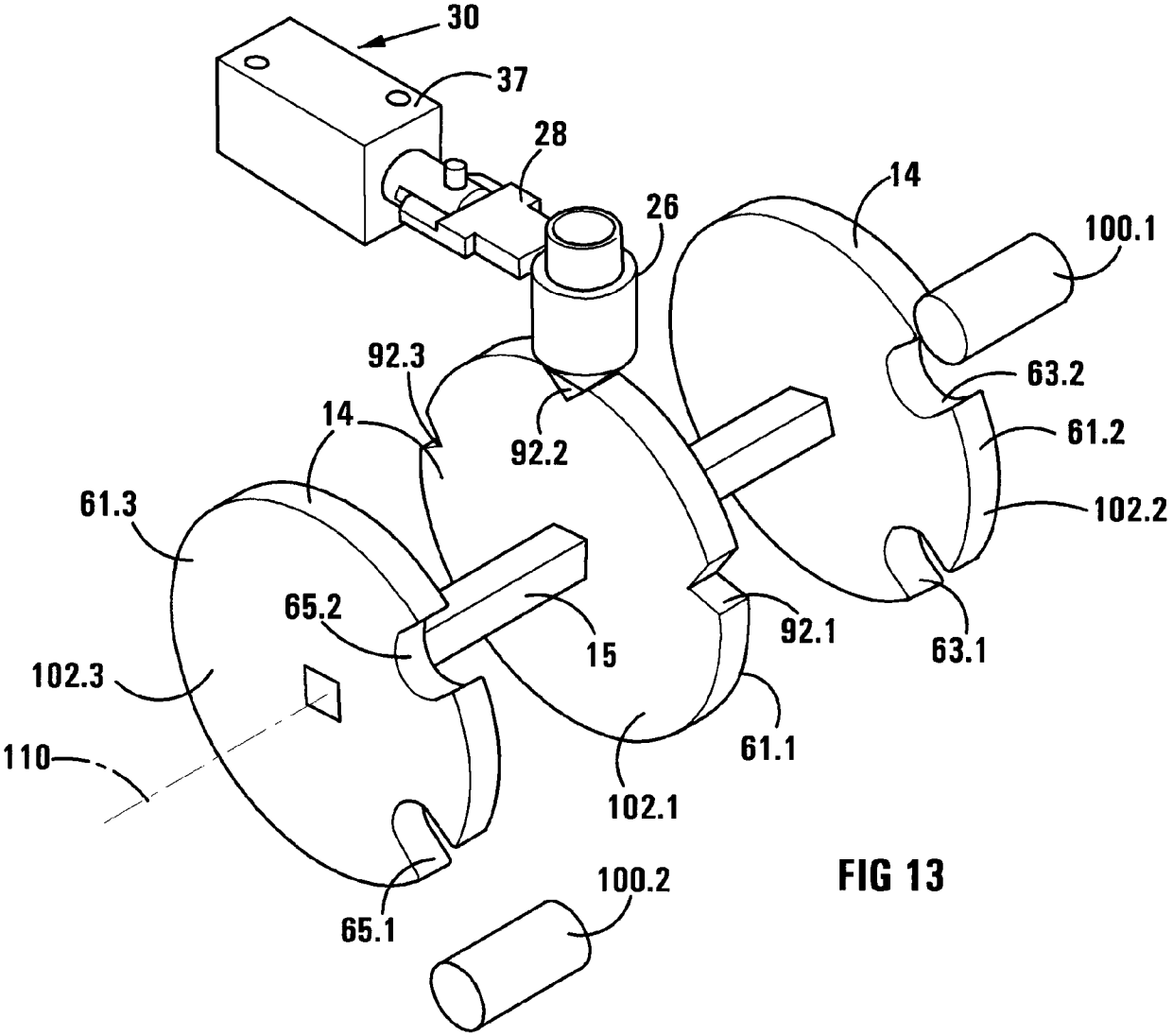
FIG. 13 shows a three-dimensional view of part of the locking arrangement of FIG. 12, when in use, where the locking arrangement has a dual locking member, with one striker element in a closed position and the other striker element in an open position.
Figure 14:
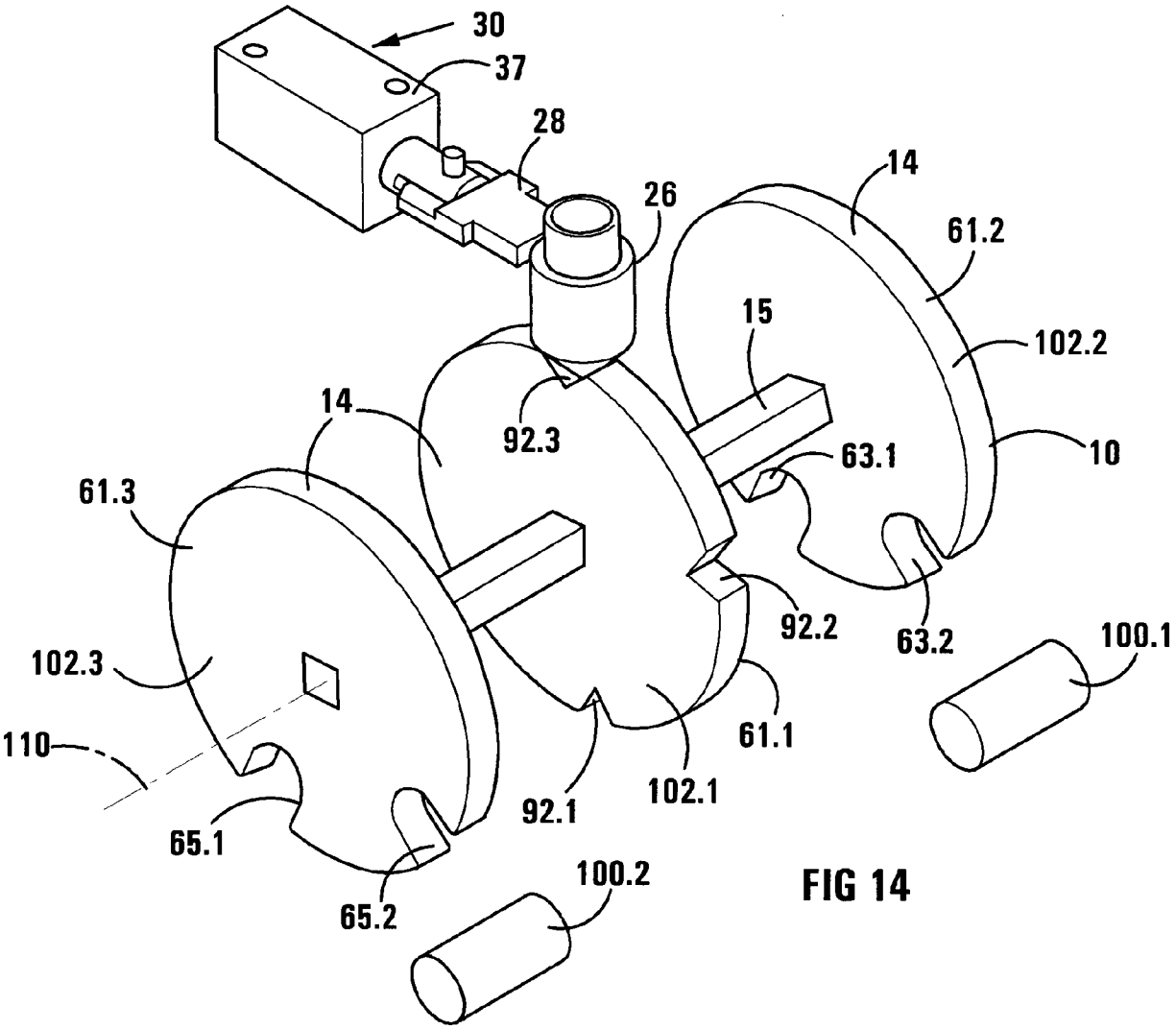
FIG. 14 shows a three-dimensional view of part of the locking arrangement of FIG. 12, when in use, where the locking arrangement has a dual locking member, with both striker elements in respective open positions.

In FIGS. 12 to 14 the locking member 14 includes first, second and third locking member elements 61.1, 61.2, 61.3. The locking member elements 61.1, 61.2, 61.3 include circular disc shaped bodies 102.1, 102.2, 102.3 and are interconnected by means of a central shaft 15 which is configured to rotate the locking member elements 61.1, 61.2, 61.3 in unison about the axis of rotation 110.

The first locking member element 61.1 includes third, fourth and fifth engagement formations which are in the form of three angularly spaced recesses 92.1, 92.2, 92.3 which lead into the body 102.1 of the first locking member element 61.1 from a radially outer side thereof. The securing member 26 is positioned on the radially outer side of the first locking member element 61.1 such that when the locking member 14 is rotated about the axis 110, the recesses 92.1, 92.2, 92.3 of the third, fourth and fifth engagement formations will, at some stage, come into register, or in line, with the securing member 26.

Figure 4:
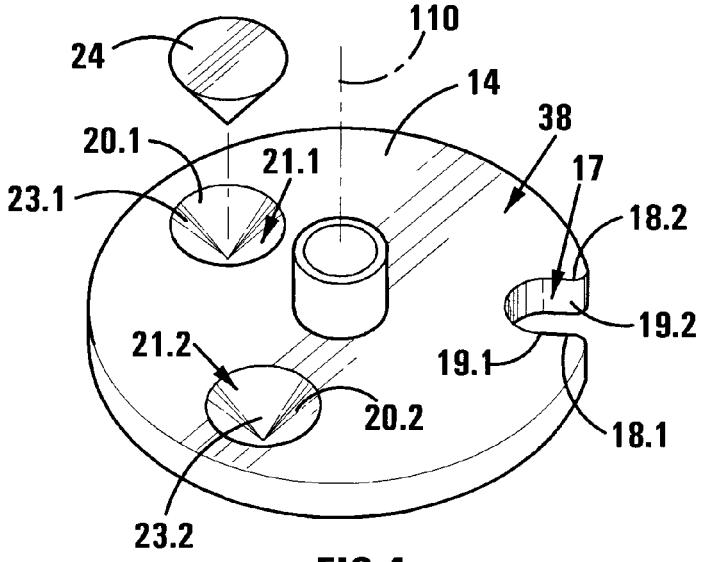
FIG. 4 shows a three-dimensional exploded view of a locking member and part of an insert of the locking arrangement of FIG. 1.

The second and third locking member elements 61.2, 61.3 each defines two angularly spaced recesses 63.1, 63.2, 65.1, 65.2 which are similar to the recess 17 shown in FIG. 4. Although not specifically indicated, the recesses 63.1, 63.2, 65.1, 65.2 each defines engagement formations for engaging with a corresponding striker element. The purpose of having both a second and a third locking member element 61.2, 61.3, each having two recesses 63.1, 63.2, 65.1, 65.2, is to allow the locking arrangement 10 to accommodate two striker elements 100.1, 100.2 (i.e. two doors). In other words, the locking arrangement 10 is configured to control access through two doors. FIG. 12 shows the two striker elements 100.1, 100.2 in their respective closed positions, with the recesses 63.1, 65.1 of the second and third locking member elements 61.2, 61.3 being positioned in the displacement path of the striker elements 100.1, 100.2.

When, for instance, striker element 100.2 is displaced towards its open position, it engages the recess 65.1 and as a result rotates the third locking member element 61.3 (assuming that the lock pin 28 is in its free or unlocked position and a sufficient amount of force is applied to the third locking member element 61.3 to displace the securing member 26 towards its unlocked position) which causes the first and second locking member elements 61.1, 61.2 also to rotate to a position shown in FIG. 13. In this position, the recess 63.2 (and not the recess 63.1) is in the displacement path of the striker element 100.1. If the striker element 100.1 is now displaced towards its open position, it will engage the recess 63.2 and as a result rotate the second locking member element 61.2 which will cause the first and third locking member elements 61.1, 61.3 to also rotate to a position shown in FIG. 14.

Figure 15:
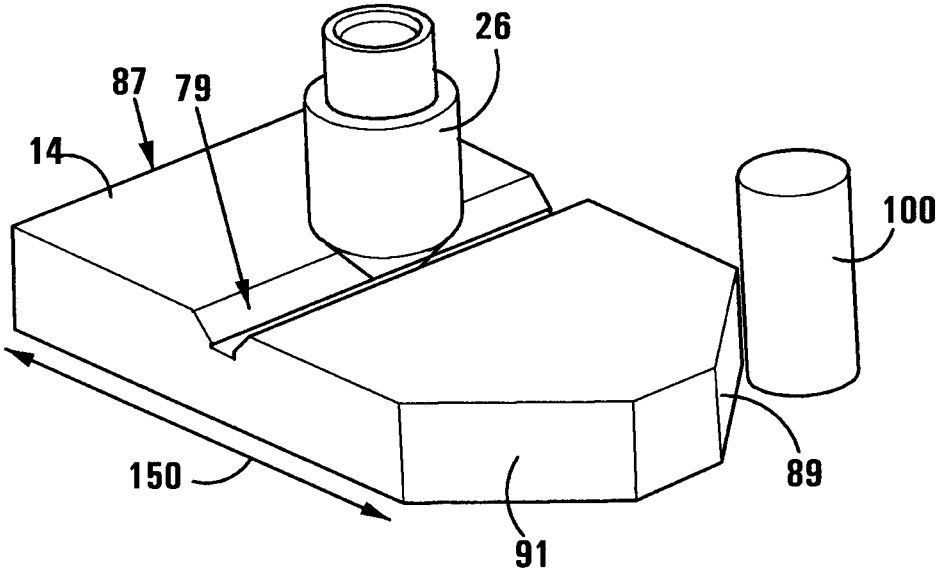
FIG. 15 shows a three-dimensional view of part of the locking arrangement of FIG. 1, when in use, where the locking arrangement has a different locking member and where the locking member is in a first locked position and a striker element is in a closed position.
Figure 16:
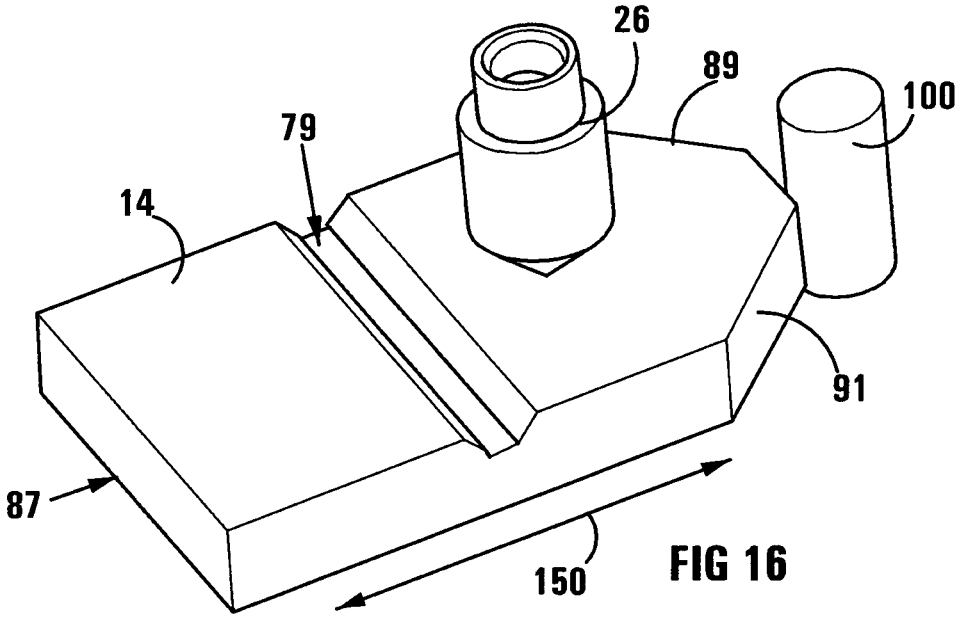
FIG. 16 shows a three-dimensional view of part of the locking arrangement shown in FIG. 15, where the locking member is displaced away from its first locked position and the striker element is positioned midway between its open and closed positions.
Figure 17:
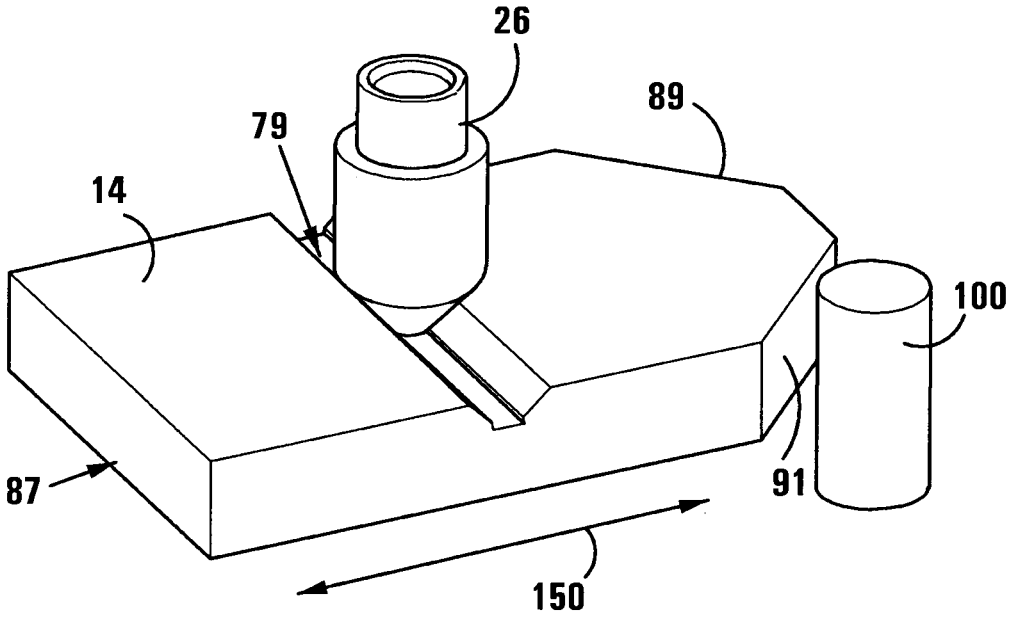
FIG. 17 shows a three-dimensional view of part of the locking arrangement shown in FIG. 15, where the locking member is in its first locked position and the striker element is in its open position.
Figure 18:
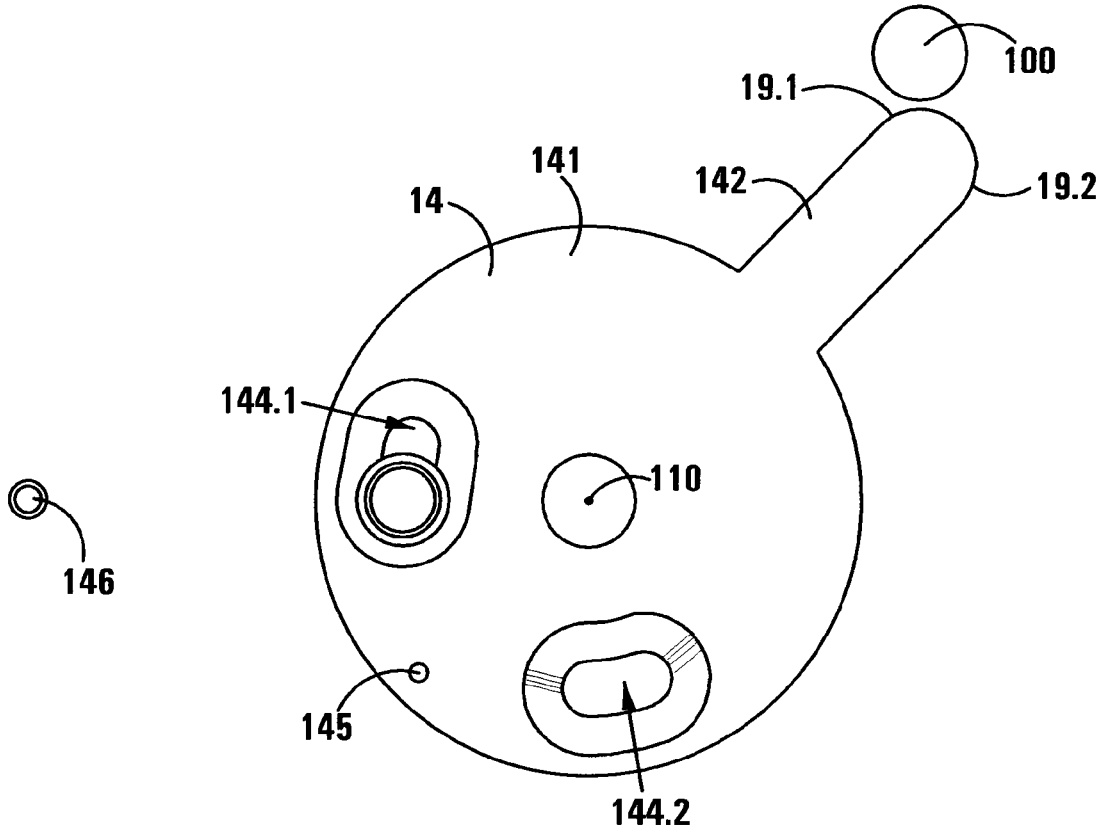
FIG. 18 shows a schematic top view of part of the locking arrangement of FIG. 1, when in use, where the locking arrangement has a different locking member and wherein the locking member is in a first locked position and the striker element is in a closed position.
Figure 19:
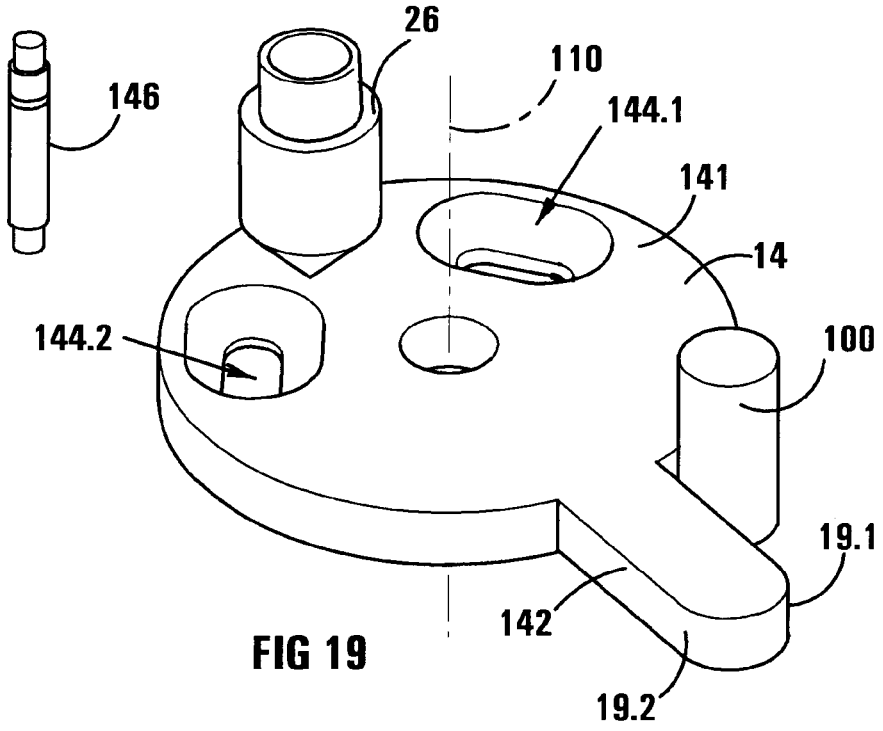
FIG. 19 shows a schematic top view of part of the locking arrangement shown in FIG. 18, where the locking member is positioned midway between its first and second locked positions.
Figure 20:
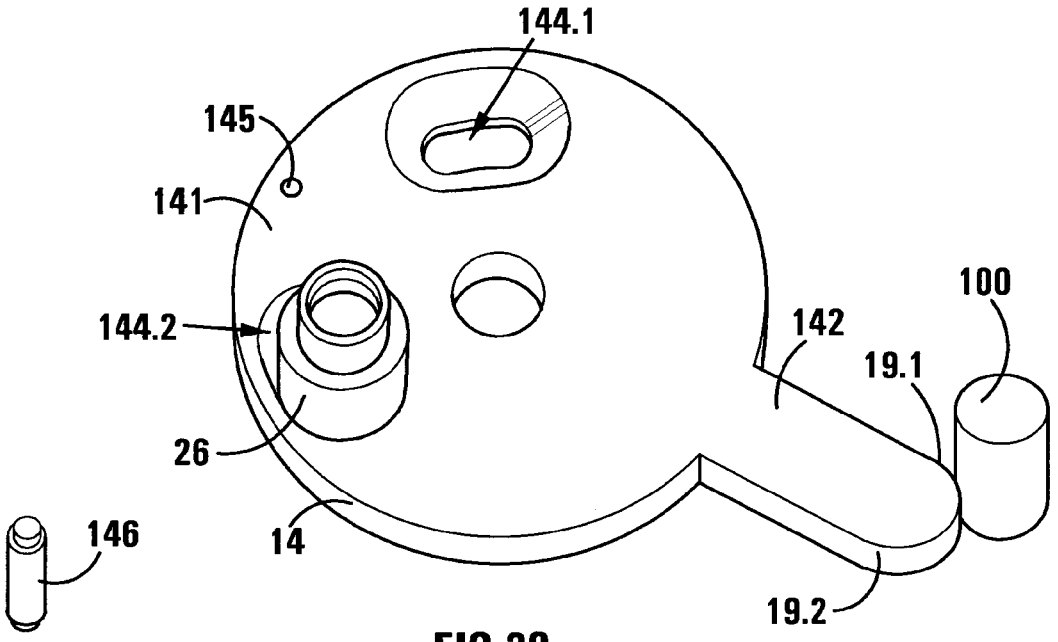
FIG. 20 shows a schematic top view of part of the locking arrangement shown in FIG. 18, where the locking member is positioned proximate a second locked position and the striker element is about to disengage with the locking member.
Figure 21:
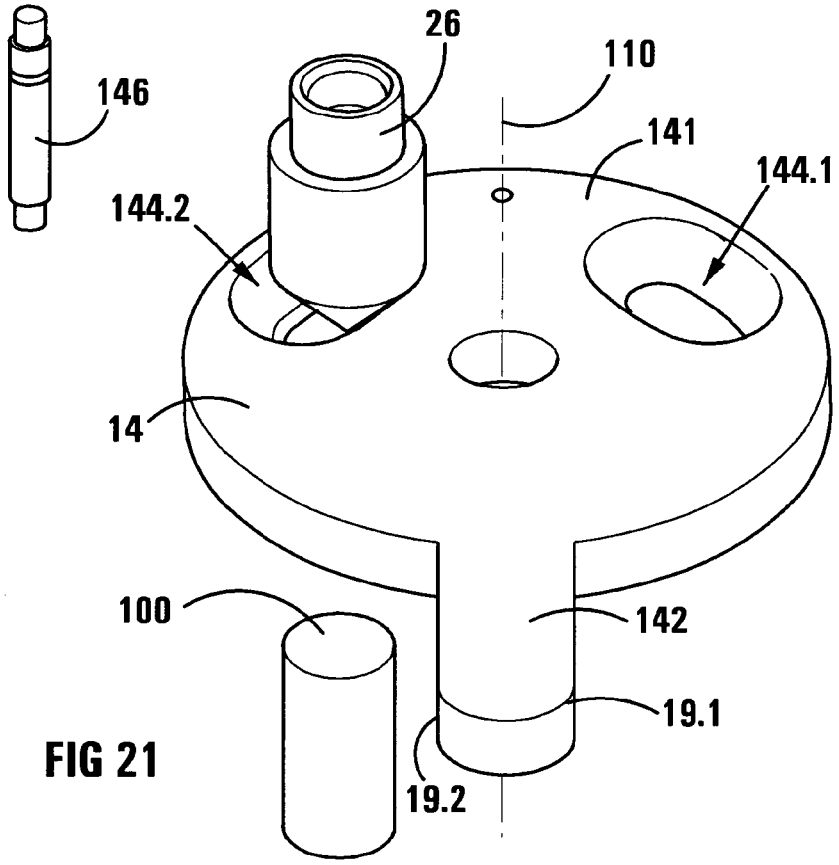
FIG. 21 shows a schematic top view of part of the locking arrangement shown in FIG. 18, where the locking member is in its second locked position and the striker element is in an open position.
Figure 22:
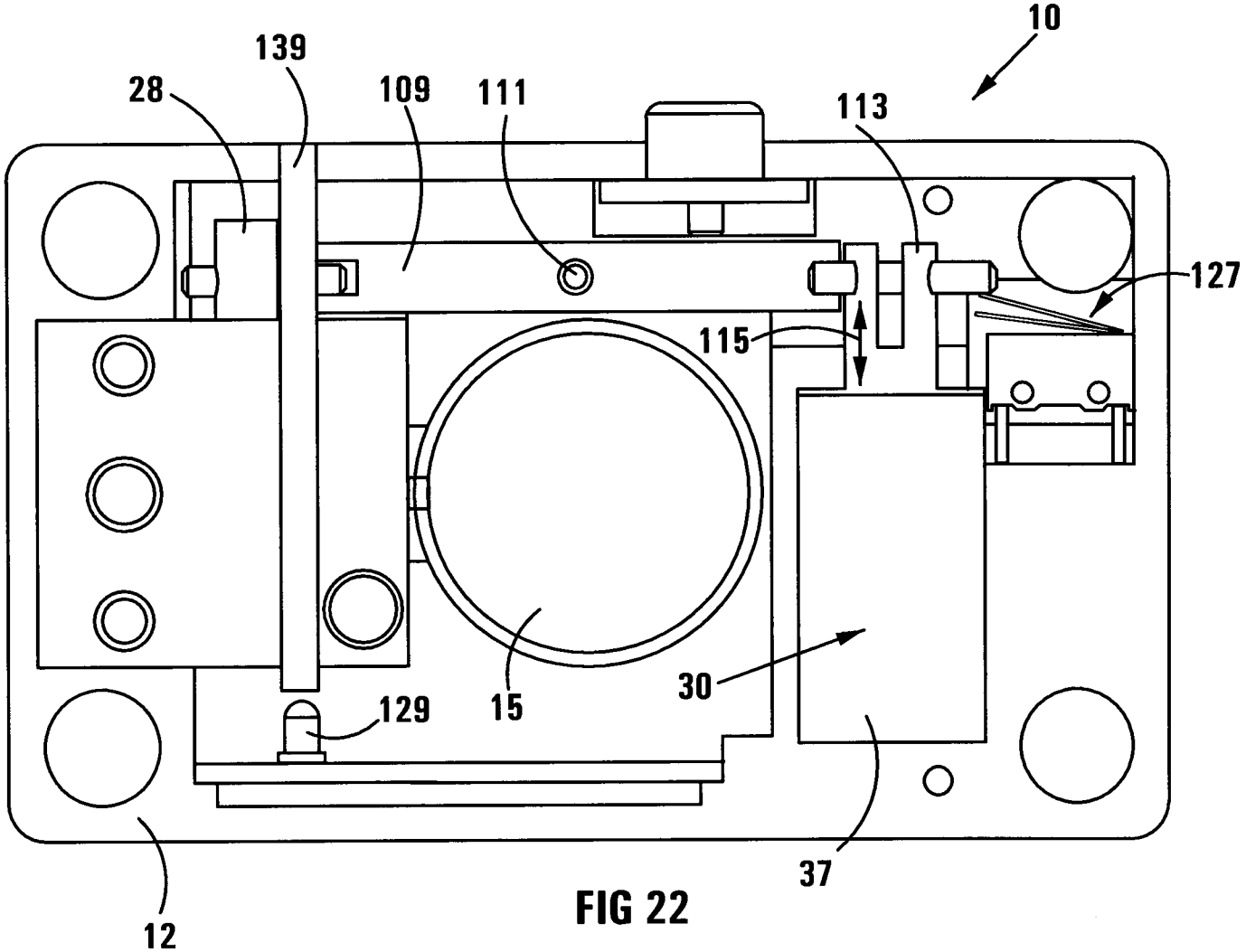
FIG. 22 shows a sectional top view of an alternative embodiment of the locking arrangement of FIG. 1.
Figure 23:
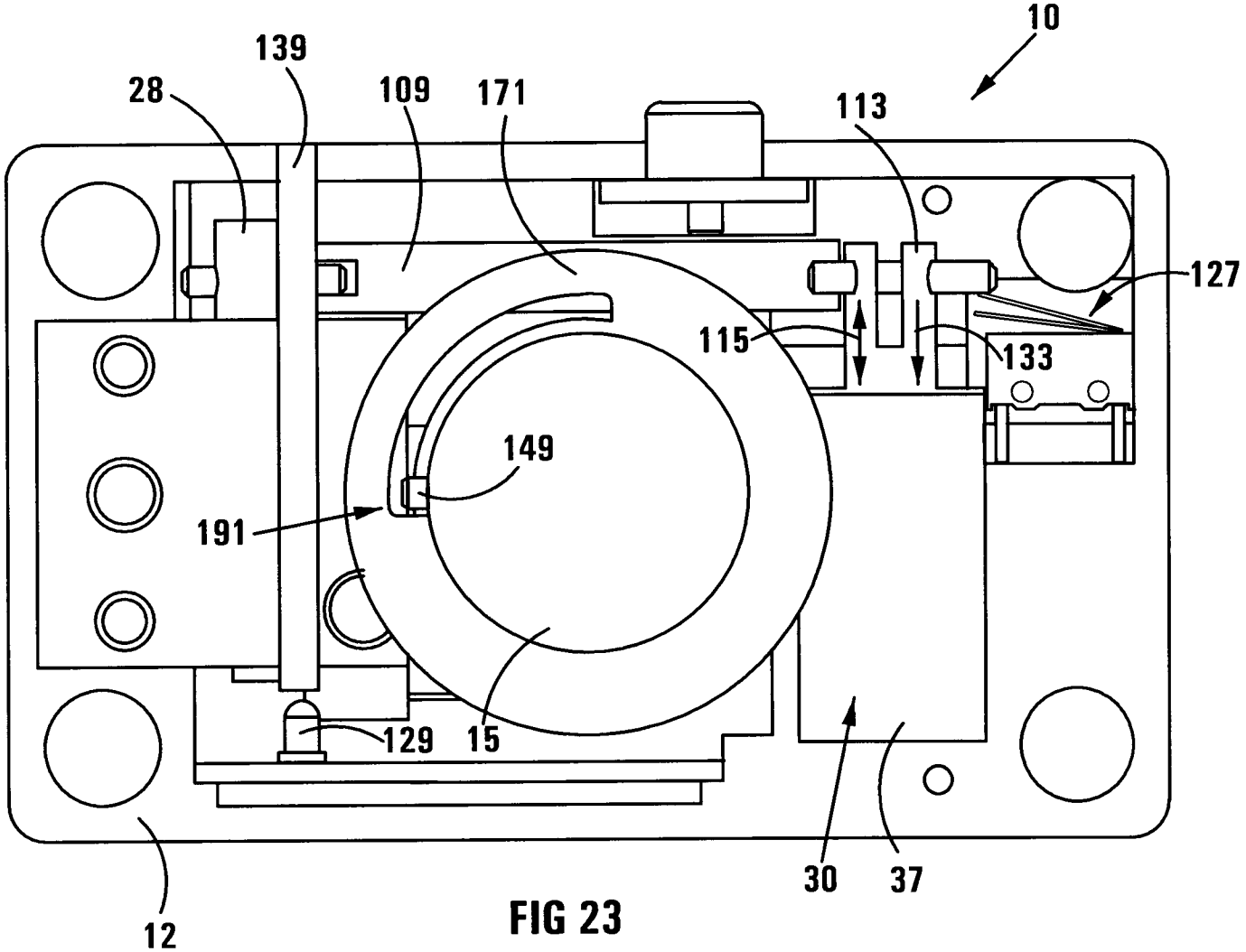
FIG. 23 shows another sectional top view of the locking arrangement of FIG. 22.
Figure 24:
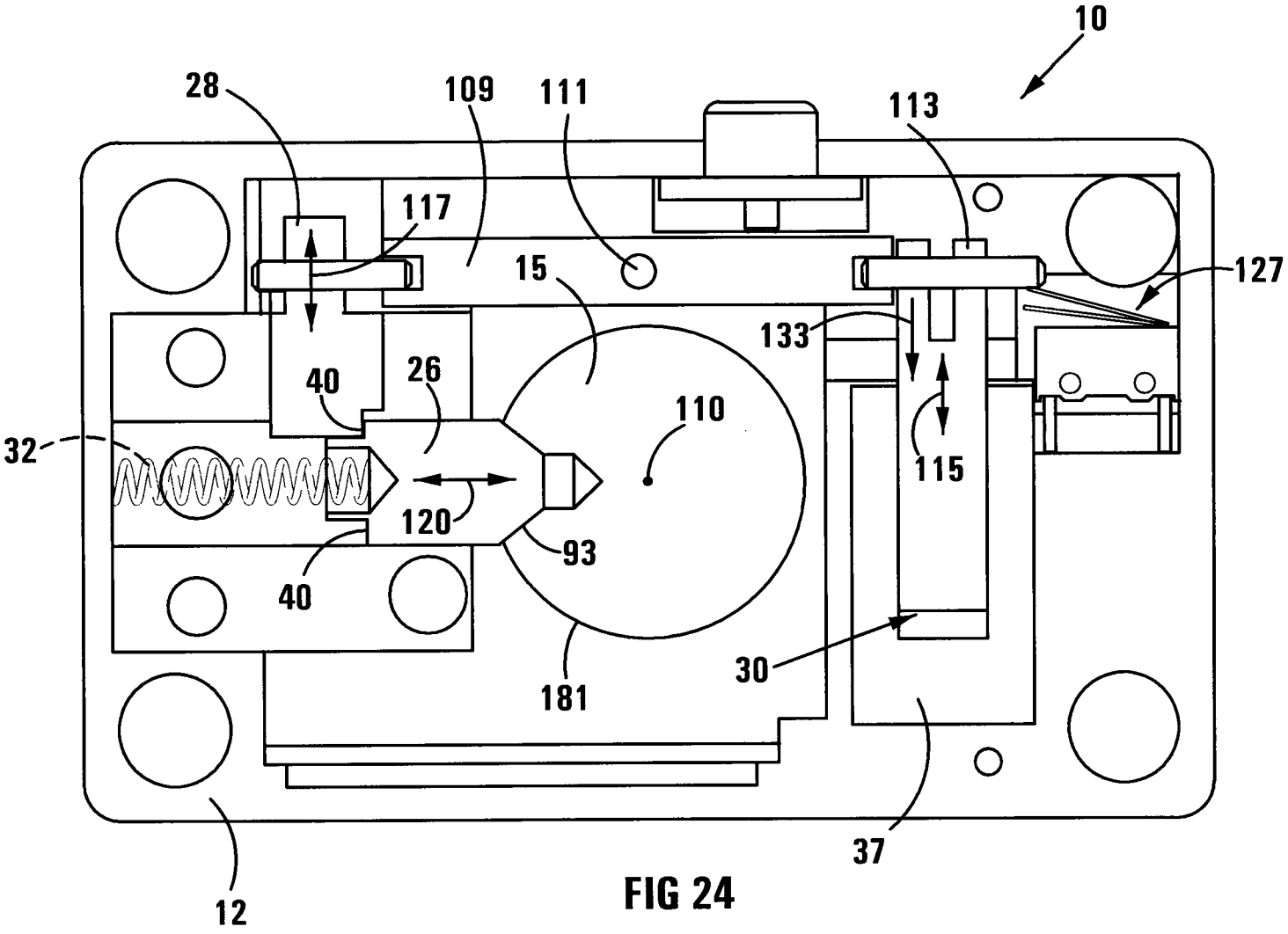
FIG. 24 shows a further sectional top view of the locking arrangement of FIG. 22.
Figure 25:
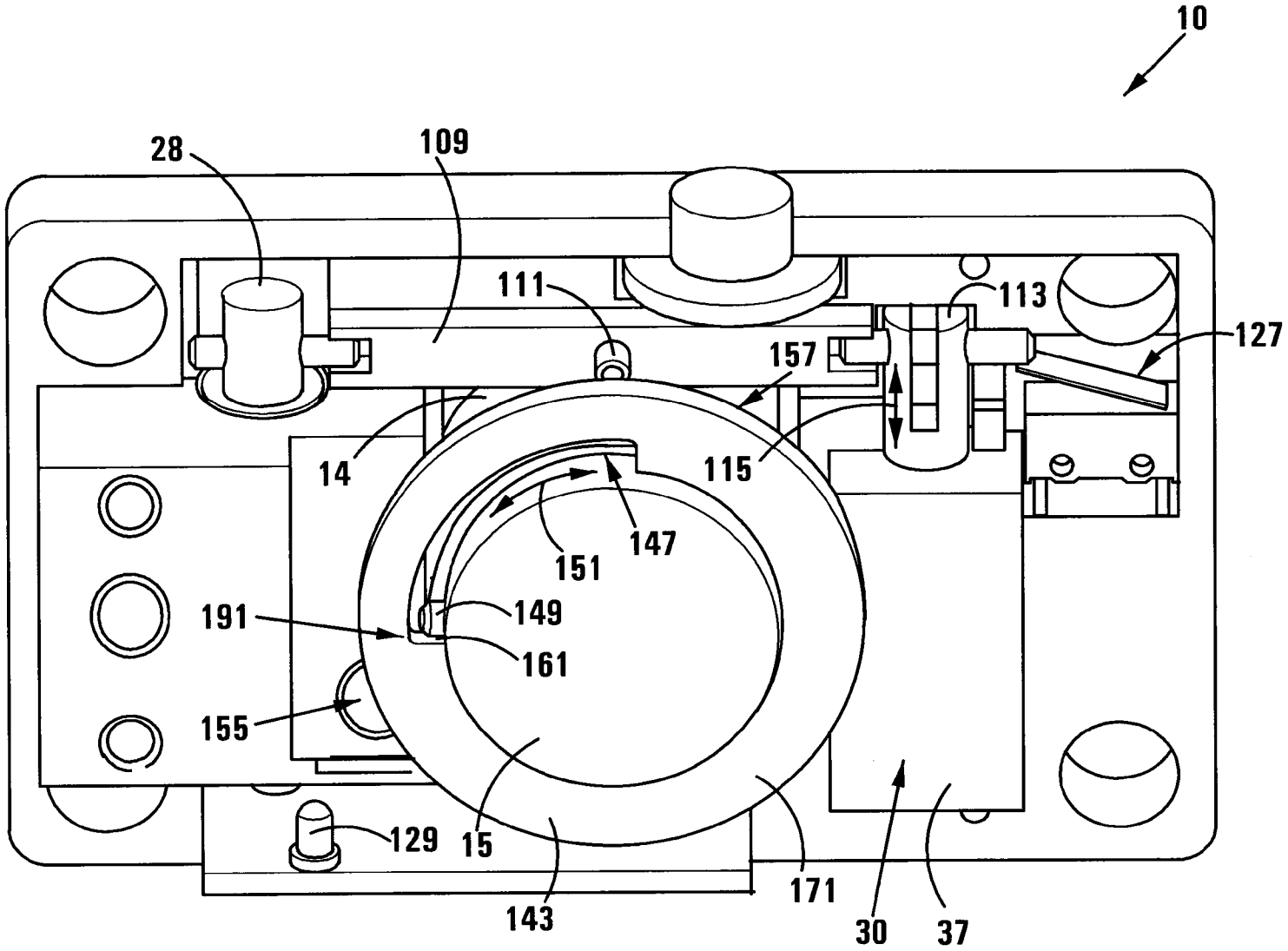
FIG. 25 shows a three-dimensional view of part of the locking arrangement of FIG. 22.

In FIGS. 15 to 17 the locking member 14 is slidably displaceable relative to the body 12, along a path generally indicated by reference numeral 150, between a locked position (shown in FIGS. 15 and 17) and an unlocked position (shown in FIG. 16). The locking member 14 defines a channel 79, having tapered sides, within which the securing member 26 can extend to lock the locking member 14 in its locked position. The locking member 14 is biased towards a locked position by a biasing means (not shown) which acts on one end 87 of the locking member 14. An opposite end of the locking member 14 has two inclined surfaces 89, 91 which act as engagement formations for engaging with a striker element 100. When the locking member 14 is in its locked position and the striker element 100 is in its closed position (see FIG. 15), the inclined surface 89 is positioned in the displacement path of the striker element 100. When the striker element 100 is displaced towards its open position, it engages with the surface 89, which causes the locking member to be displaced towards its unlocked position (see FIG. 16) against the bias of the biasing means which, in turn, causes the securing member 26 to be urged towards its unsecured position. Once the striker element 100 has passed the locking member 14, the biasing means will displace the locking member 14 back into its locked position (see FIG. 17). In this position, the surface 91 is now in the displacement path of the striker element 100.

In FIGS. 18 to 21 the locking member 14 has a circular disc shaped body 141 which is rotatable relative to the body 12 of the locking arrangement 10 (not specifically shown) about an axis of rotation 110. A finger shaped formation 142 projects radially outwardly from the body 141. The formation 142 defines first and second engagement formations 19.1, 19.2 which, in use, are positioned in the displacement path of a striker element 100. The locking member 14 defines two angularly spaced slots 144.1, 144.2 within which the securing member 26 is receivable for locking the locking member 14 releasably in its first and second locked positions. The body 141 of the locking member 14 defines a small hole 145 which is located midway between the two slots 144.1, 144.2, proximate a radially outer side of the body 141. A biasing means (e.g. a spring; not specifically shown) is connected between the locking member 14, by extending through the hole 145, and a post/bar 146 which is connected to the body 12 (not specifically shown). The purpose of the biasing means is to bias the locking member 14 towards a neutral position such that after the striker element 100 has displaced the locking member 14 out of its displacement path during use (see FIG. 20), the biasing means will urge the locking member 14 back towards its first or second locked position shown in FIGS. 18 and 21.

Figure 28:
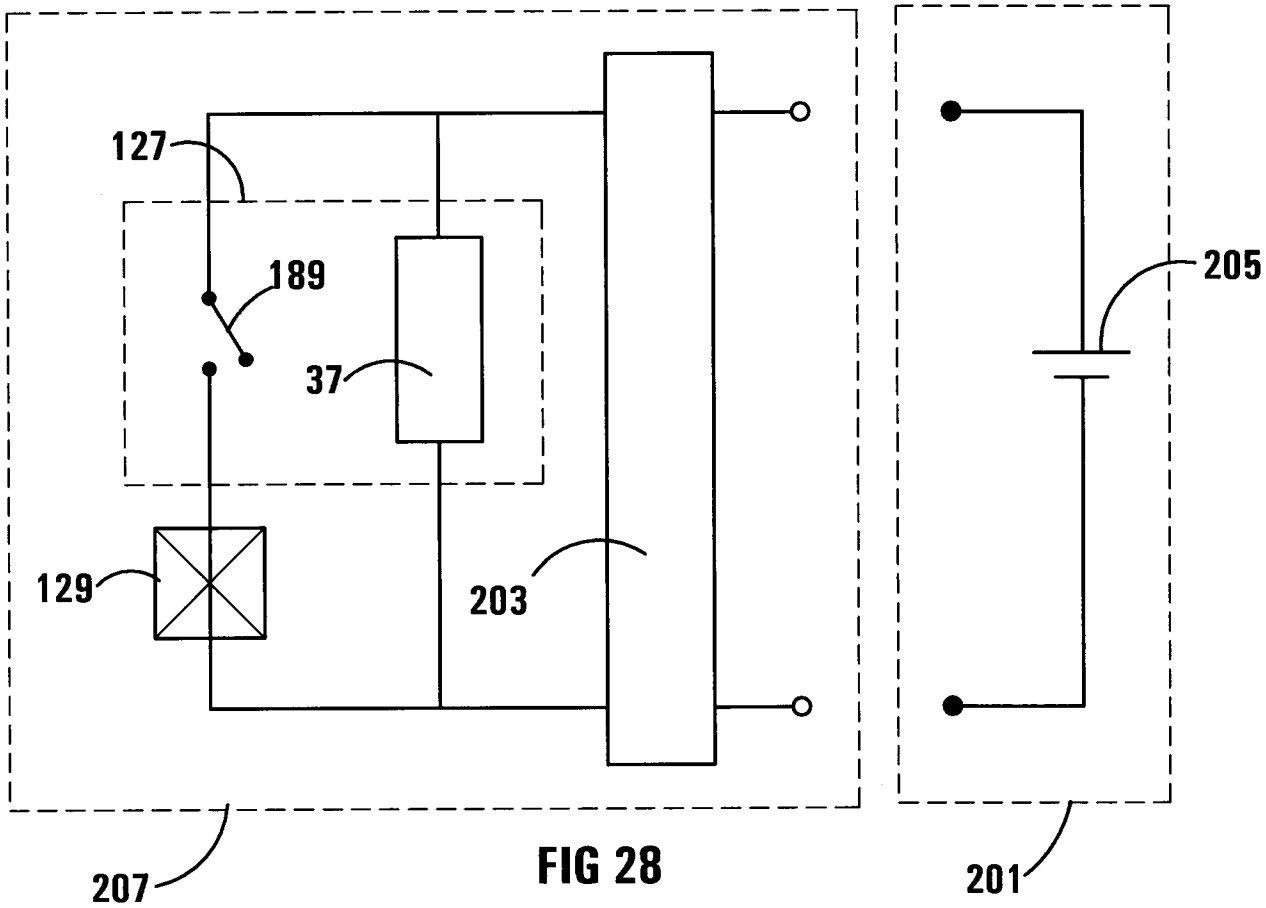
FIG. 28 shows a schematic circuit layout of the locking arrangement of FIG. 22.
Figure 29:
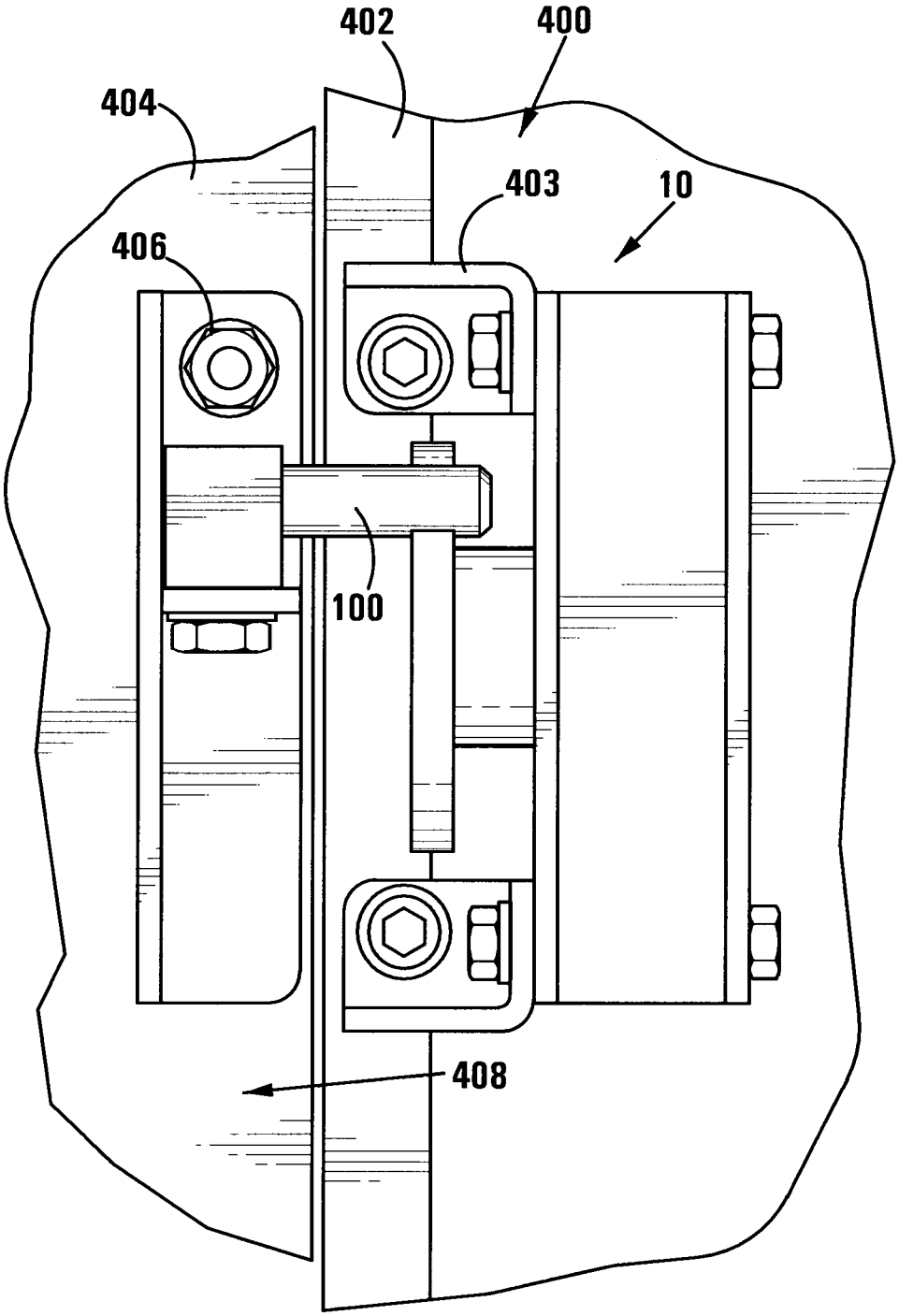
FIG. 29 shows a front view of a lock installation in accordance with the invention.

FIGS. 22 to 28 illustrate another embodiment of the locking arrangement 10, whereas FIG. 29 illustrates a lock installation 400 which incorporates the locking arrangement 10. Again, unless otherwise indicated, the same reference numerals used in FIGS. 1 to 9 will be used to designate similar components in FIGS. 22 to 27.

Figure 26:
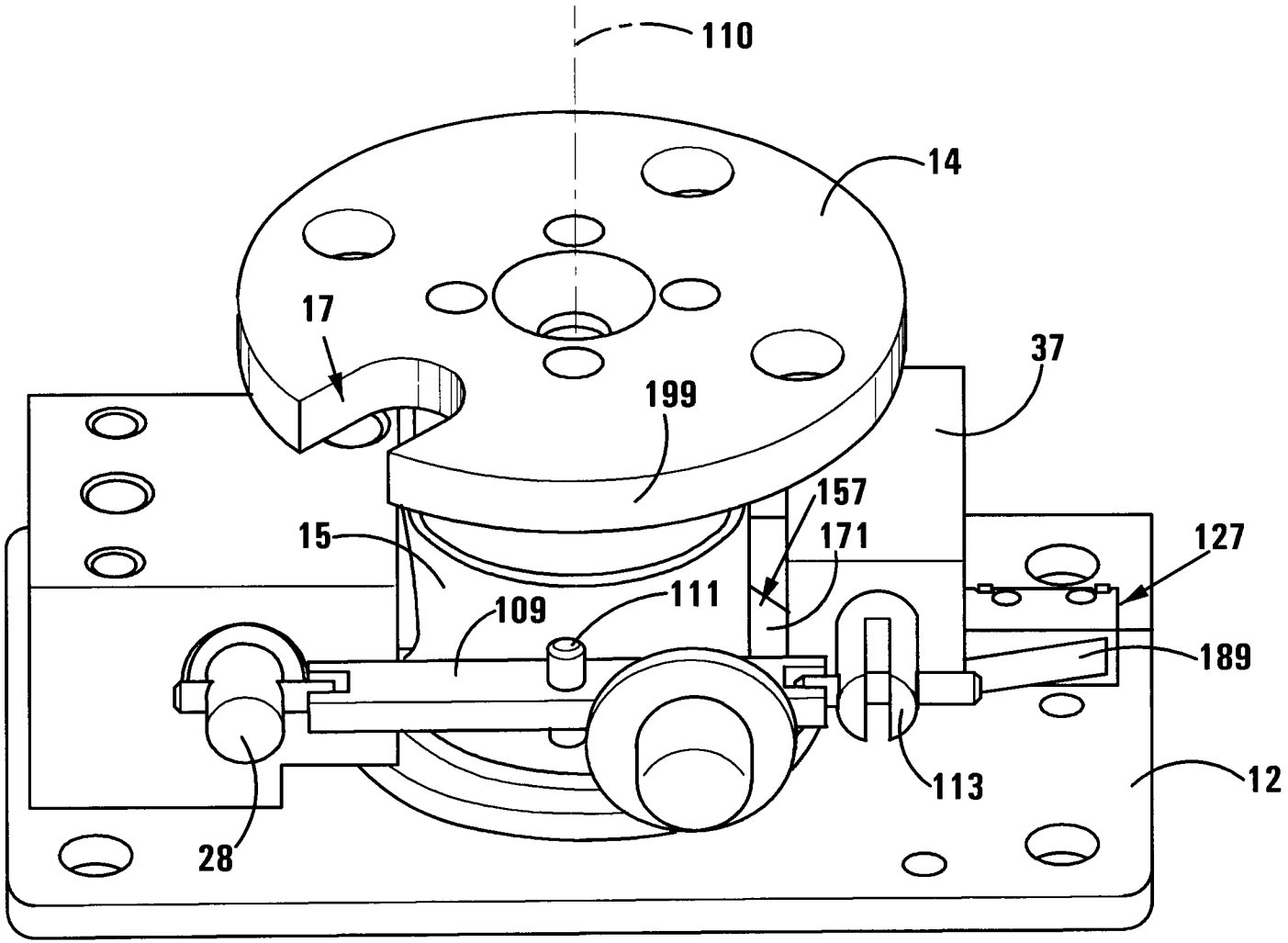
FIG. 26 shows another three-dimensional view of part of the locking arrangement of FIG. 22.
Figure 27:
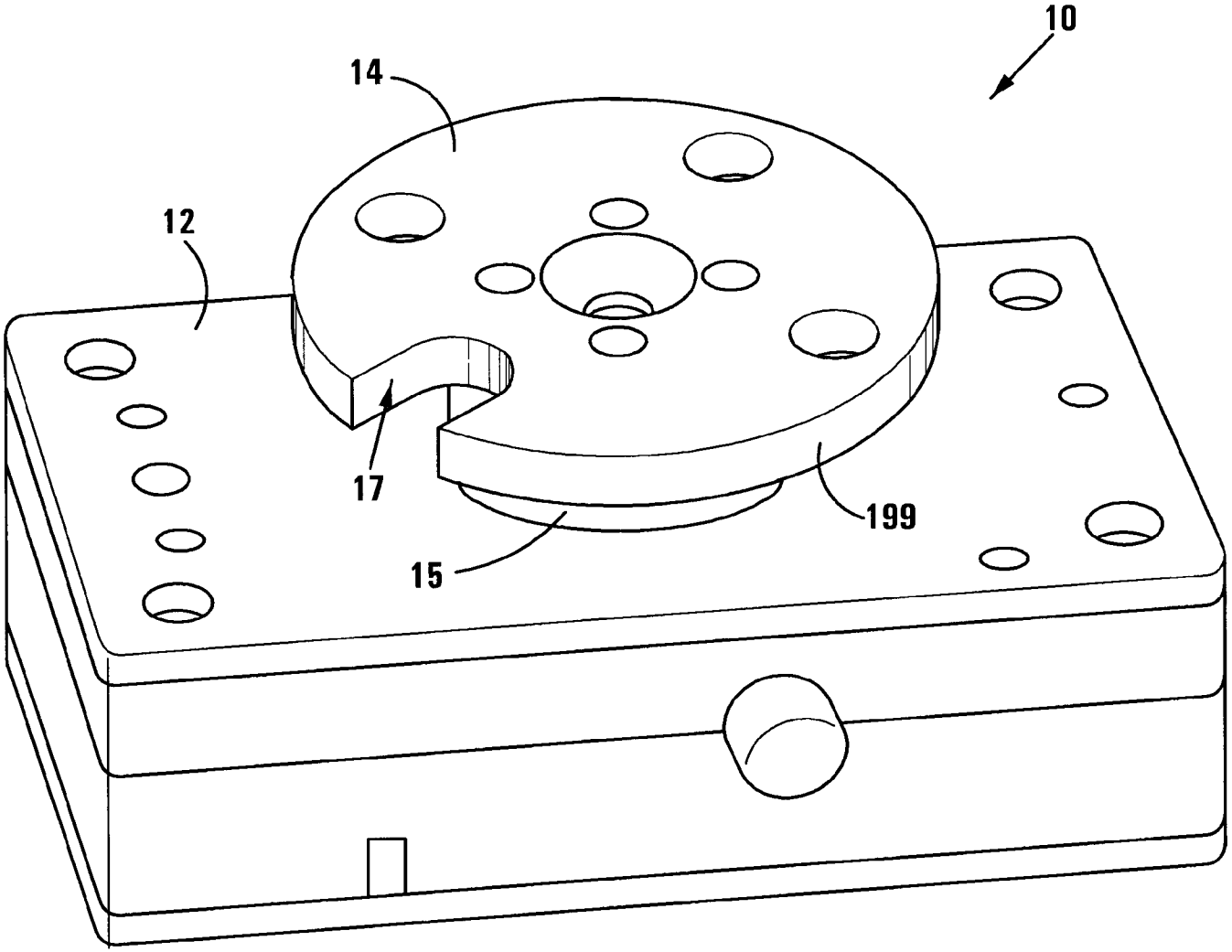
FIG. 27 shows a three-dimensional view of the locking arrangement of FIG. 22.

In this embodiment, the locking member 14 is mounted on a thick shaft 15 such that rotation of the shaft 15 about an axis 110 causes rotation of the locking member 14 (see FIG. 26). The shaft 15 defines a recess 93 which leads into a body of the shaft 15 from a radially outer side thereof (see FIG. 24) into which a locking member 26, which is positioned on a radially outer side of the shaft 15, is receivable. The specific configuration between the securing member 26 and the shaft 15 (and recess 93), in this embodiment, is similar to the configuration between the securing member 26 and locking member element 61.1 (and its recesses 92.1-92.3) illustrated in FIG. 14.

The locking arrangement 10 includes a first order lever 109 which is pivotally connected to the body 12 via a pivotal connection 111. One end of the lever 109 is connected to an actuator arm 113 of the displacement arrangement 30, while the other end of the lever 109 is connected to the lock pin 28 which is generally thicker than the lock pin 28 illustrated in FIG. 3. The displacement arrangement 30 and lock pin 28 are arranged such that an actuating path 115 of the actuator arm 113 is spaced from, and parallel to, a displacement path 117 of the lock pin 28 as it travels into and out of engagement with a shoulder 40 of the securing member 26. The lock pin 28 and actuator arm 113 are substantially of the same weight.

If the locking arrangement 10 illustrated in FIGS. 1 to 9 is subjected to excessive vibrations, the lock pin 28 might, in certain cases, disengage from the shoulder 40 (and allow the securing member 26 to be displaced towards its unsecured position). This is due to the fact that the lock pin 28 is longitudinally/linearly aligned with an actuating path of the actuator or displacement arrangement 30 and is connected thereto. If therefore the lock pin 28 (when in its locked position) and an actuator arm of the actuator 30 are subjected to a vibrational force which urges them along the actuating path away from the locked position of the lock pin 28, then these forces will, in a sense, be combined and if the combined force is large enough, may end up temporarily displacing the lock pin 28 out of engagement with the shoulder 40. However, in the embodiment illustrated in FIGS. 22 to 27, the lever 109 counters the respective vibrational forces which the actuator arm 113 and the securing member 26 may be subjected to. More specifically, since the actuating path 115 and displacement path 117 are parallel to each other, vibrational forces which act on the actuator arm 113 and the securing member 26 will tend to urge them in the same direction along their respective paths 115, 117. However, since the actuator arm 113 and the securing member 26 are connected to the respective ends of a first order lever 109, the lever 109 will cause the respective vibrational forces acting on the actuator arm 113 and the securing member 26 (in the same direction) to work against each other (i.e. cancelling each other out). This is further aided by the fact that the lock pin 28 and actuator arm 113 are similar in weight.

The locking arrangement 10 includes a switch arrangement 127 which is configured to operate an operating light such as an LED 129 and which is operatively connected to the displacement arrangement 30 such that when the displacement arrangement 30 displaces the lock pin 28 out of engagement with the shoulder 40 (i.e. into its unlocked position), it causes the switch arrangement 127 to power the LED 129.

An operating device 201 can be used, to operate the locking arrangement 10 in a key-like fashion (see FIG. 28). More specifically, the locking arrangement 10 includes an operating socket or receiving device 203 which is configured to receive and cooperate with the operating device 201. The operating device 201 includes a power source 205 (e.g. a battery) which is configured to provide power to the receiving device 203 which, in turn, is configured to transfer at least some of the power received from the power source 205 to the solenoid 37, which forms part of an electric circuit 207, when the correct operating device 201 is inserted. The LED 129 forms part of the circuit 207 and is connected thereto via the switch arrangement 127.

When the solenoid 37 is not powered, the actuator arm 113 is locked in an extended/erect position. As a result, the lever 109 urges/forces the lock pin 28 into its locked position. When the correct operating device 201 is inserted into the receiving device 203, the receiving device 203 establishes (e.g. by means of a switch) an electrical connection between the power source 205 and the solenoid 37. As soon as the solenoid 37 is powered, it displaces the actuator arm 113 from its extended/erect position towards a retracted position (i.e. the actuator arm 113 is displaced in the direction of arrow 133 along the displacement path 115). As a result, the lever 109 urges/forces the lock pin 28 out of engagement with the shoulder 40 of the securing mechanism 16 into its unlocked position, thereby allowing the locking member 14 to rotate (e.g. to open a door to which the locking arrangement 10 is mounted) by applying a sufficient amount of torque/rotational force on the shaft 15 and locking member 14 (as described earlier in the specification). The actuator arm 113 is operatively connected to the switch arrangement 127 such that when the actuator arm 113 is in its extended/erect position, a switch 189 of the switch arrangement 127 is in an open condition (i.e. the LED 129 is disconnected from the circuit 207) and when the actuator arm 113 is displaced towards its retracted position, to switch the switch 189 to a closed condition, thereby connecting the LED 129 to the circuit 207 (and power source 205).

The locking arrangement 10 defines a light transmitting rod 139 which extends from the LED 129 towards an outer side of the body 12 and which is configured to channel the light from the LED 129 towards the outside, which can then be viewed by an operator. The light from the LED 129 will therefore be indicative that the correct operating device 201 has been inserted into the receiving device 203 and that the locking pin 28 is in its unlocked position.

From the above, it is clear that the locking arrangement 10 does not require a power source to ensure that a door to which the locking arrangement 10 is mounted remains locked. The locking arrangement 10 in fact only requires power in order to unlock the locking pin 28 of the locking arrangement 10. (The operating device 201, receiving device 203 and circuit 207 can also be implemented in the other embodiments of the locking arrangement 10 described above.)

The locking arrangement 10 further includes a limiting mechanism 191 which is configured to limit the amount of rotation of the locking member 14 and shaft 15 relative to the body 12. More specifically, the limiting mechanism 191 is configured to help preserve/maintain the relative rotational position of the locking member 14 relative to the body 12, when the locking member 14 has been displaced into a fully open position. The limiting mechanism 191 includes a first limiting member 143 which has an annular disk-shaped body 171 which is rotatably fitted over the shaft 15 and which is rotatable relative to the body 12. The limiting mechanism 191 also includes a second limiting member in the form of a stub formation 149 which projects/protrudes radially outwardly from the shaft 15.

The first limiting member 143 defines an inner, elongate cut-out 147 which, when the first limiting member 143 is fitted over the shaft 15, extends along a circumference of the shaft 15. The cut-out 147 defines a path 151. The stub formation 149 is located in the cut-out 147 and can therefore move along the displacement path 151 as the shaft 15 (and locking member 14) is rotated relative to the first limiting member 143. The limiting mechanism 191 further includes a securing element in the form of a screw which can be used to secure the first limiting member 143 to the body 12 in a specific relative rotational position.

The relative rotational position can be determined by displacing the striker element 100 along its displacement path from a closed position towards an open position such that it, at some stage, engages with the locking member 14 by extending into the recess 17 (which is positioned in the displacement path of the striker element 100) and rotates the locking member 14 (as well as the shaft 15) until the striker element 100 disengages from the locking member 14 (more specifically the recess 17). When the locking member 14 is in this position it is in a fully open position. As the locking member 14 is rotated towards its fully open position, the securing member 26 will at some stage be displaced out of its secured position inside the recess 93 and into its unsecured position where it abuts a radially outer surface 181 of the shaft 15. As the shaft 15 rotates, a portion 161 of the body 171, which defines one of the ends of the path 151, engages, at some stage, with the stub formation 149, which causes the first limiting member 143 to rotate together with the shaft 15. When the locking member 14 has been rotated into its fully open position, the screw is inserted via an access hole 155 in order to engage frictionally with an annular surface 157 of the body 171 to thereby prevent relative rotation between the first limiting member 143 and the body 12 in the same direction. The screw, when inserted, is oriented generally perpendicular to a plane in which the annular surface 157 extends. The insertion of the screw is conducted during the installation of the locking arrangement 10.

If, when in its fully open position, the locking member 14 is inadvertently rotated back towards a closed position such that the recess 17 is displaced out of register with the displacement path of the striker element 100, then the striker element 100, when displaced back along its displacement path towards its closed position, will engage a radially outer side 199 of the locking member 14 instead of the recess 17. In order to correct the rotational position of the locking member 14 it can merely be rotated manually (relative to the body 12) towards its fully open position until the locking member 14 cannot rotate any further as a result of the screw and the portion 161 which engages with the stub formation 149, which prevent further rotation in the same direction. When the locking member 14 reaches this position, it will be in its fully open position and the recess 17 will be in register with the displacement path of the striker element 100. The screw, together with the portion 161 and stub formation 149, also helps prevent the locking member 14 from being inadvertent rotated past its fully open position.

The lock installation 400 illustrated in FIG. 29 includes a support structure, which in this example is a door frame 402, a door 404 which is hingedly mounted to the door frame 402, a locking arrangement 10 which is mounted to the door frame 402 by means of a mounting structure 403 and a striker element 100 which is mounted to the door 404 by means of a mounting structure 406.

The door frame 402 defines an access opening 408 through which access is granted to an access-restricted enclosure/area of which the door 404 and door frame 402 form part of. The door 404 is hingedly displaceable relative to the door frame 402 between a closed position in which the door 404 closes off the access opening 408 in order to prohibit access to the access-restricted enclosure/area through the access opening 408, and an open position where the access opening 408 is not closed off by the door 404, thereby providing access to the access-restricted enclosure/area through the access opening 408.

The Inventor believes that the invention provides both a cost effective locking arrangement and access controlled system. The Inventor also believes that the locking arrangement 10 is relatively easy to install and inexpensive. The locking arrangement 10 also draws significantly less current than current electro-magnetic locks the Inventor is aware of, i.e. 300 mA versus 5 A, which is largely due to the fact that the striker element 100 is not in constant engagement with the locking member 14.

A further advantage of this invention is the fact that in the embodiment illustrated in FIGS. 22 to 28, the locking arrangement 10 only requires power in order to unlock the locking pin 28.

The invention claimed is:

1. A locking arrangement which includes:

a body;

a locking member displaceable relative to the body;

a securing mechanism configured to secure the locking member releasably in at least one position;

the securing mechanism including a securing member which is displaceable relative to the locking member between a secured position where the securing member engages with a recess or opening in the locking member to secure, or releasably secure, the locking member relative to the body and an unsecured position where the locking member is allowed to be displaced relative to the body the securing mechanism including a biasing means which is configured to bias the securing member towards its secured position, the securing mechanism including a fixing member which is displaceable along a displacement path relative to the securing member between a fixed position wherein the fixing member fixes the securing member in its secured position and a free position wherein the securing member is allowed to be displaced to its unsecured position;

the fixing member connected to an actuator arm of an actuator which includes a solenoid, the solenoid configured to displace the fixing member out of engagement with the securing member from its fixed position towards its free position;

the actuator arm being displaceable along an actuating path which is parallel to the displacement path;

the fixing member connected to the actuator arm via a first order lever having a pivotal connection via which the lever is connected to the body or part of the locking arrangement which is fixed relative to the body;

the fixing member and actuator arm being connected to the lever on opposite sides of the pivotal connection such that displacement of the fixing member along the displacement path is in a direction opposite to the direction of displacement of the actuating arm along the actuating path; and wherein the locking member includes angularly spaced recesses configured to receive the securing member therein to releasably secure the locking member relative to the body, each recess or opening having a tapered surface configured such that when the securing member is in its secured position in engagement with one of the recesses or openings and the fixing member is displaced to its free position and a force is applied to the locking member, the tapered surface functions in the manner of a cam surface to displace the securing member against the bias of the biasing means to its unsecured position and thereby permit displacement of the locking member relative to the body.

2. An access control system which includes:

a locking arrangement as claimed in claim 1; and a control unit which is connected to the locking arrangement and which is configured to receive an input from a user; determine whether, based on the input received from the user, access may be granted; and if so, to grant access by communicating with the locking arrangement to allow the locking member to be displaced, relative to the body of the locking arrangement, away from its first locked position.

3. A locking arrangement as claimed in claim 1, wherein the locking member defines at least one striker element engagement formation configured to engage a striker element for part of its displacement relative to the locking arrangement along a predetermined displacement path;

the locking member displaceable between first and second spaced apart positions in each of which the engagement formation is positioned such that said striker element is releasably engageable therewith and between which said striker element is in engagement with the engagement formation such that the striker element can be spaced apart from and not in constant engagement with the striker element engagement formation when the locking member is in its first and second positions permitting relative displacement between the striker element and the locking arrangement.

4. The locking arrangement as recited in claim 1, wherein the recess is provided in a top surface of the locking member which is parallel to the plane in which the locking member is displaceable, the recess receives the securing member therein when the locking member is in the secured position.

5. The locking arrangement as recited in claim 1, wherein the actuator arm and the fixing member are displaceable in opposite directions from one another.

6. The locking arrangement as recited in claim 1, wherein the locking member includes locking member elements that include circular disc shaped bodies.

7. The locking arrangement of claim 3, wherein the locking member is angularly displaceable relative to the body, the locking member being angularly displaceable between the first and second positions, which are angularly spaced from each other.

8. The locking arrangement of claim 7, wherein the locking member is pivotally/rotationally connected to the body.

9. The locking arrangement of claim 3, wherein the predetermined displacement path is in a first displacement direction, when the first engagement formation engages with the striker element and as the striker element is displaced relative to the locking arrangement further along the predetermined displacement path in the first displacement direction, away from a first locked position, the locking member also including a second striker element engagement formation, which is either separate from, or forms part of, the first striker element engagement formation, the second engagement formation being configured to engage the striker element for part of its displacement relative to the locking arrangement along the predetermined displacement path in a second displacement direction which is opposite the first displacement direction, wherein the locking element is configured to be displaced relative to the body, when the second engagement formation engages with the striker element and as the striker element is displaced relative to locking arrangement further along the displacement path in the second displacement direction, away from a second locked position.

10. The locking arrangement as recited in claim 6, wherein the circular disc shaped bodies interconnected by a central shaft which is configured to rotate the locking member elements in unison about an axis of rotation.

11. The locking arrangement of claim 9, which includes a limiting mechanism which is engageable with the locking member, at least at some stage, during displacement of the locking member relative to the body in order to limit the amount of relative displacement between the locking member and the body.

12. The locking arrangement of claim 9, wherein the securing mechanism is configured to secure the locking member releasably in the first locked position and/or the second locked position, wherein the securing member is displaceable relative to the locking member between a secured position where the securing member secures, or releasably secures, the locking member relative to the body in the first and/or second locked positions and an unsecured position where the locking member is allowed to be displaced relative to the body.

13. The locking arrangement of claim 11, which includes a shaft which is rotatably mounted to the body and to which the locking member is connected such that rotation of the shaft causes rotation of the locking member.

14. The locking arrangement of claim 13, wherein the limiting mechanism includes a first limiting member which is rotatably fitted over the shaft and rotatable relative to the body, and a second limiting member which projects/protrudes radially outwardly from the shaft and which is engageable with the first limiting member, at least at some stage, during the displacement of the locking member between its first and second locked positions, in order to limit the amount of relative displacement between the locking member and the body, and wherein the first limiting member defines a recess/cavity which extends along a circumference of the shaft and in which at least part of the second limiting member is located, the recess/cavity defining a path A along which the at least part of the second limiting member is displaceable, when the shaft is rotated relative to the first limiting member.

15. The locking arrangement of claim 12, wherein when the securing member is in its secured position, it releasably secures the locking member relative to the body in the first locked position and/or the second locked position, and wherein the fixing member which is displaceable relative to the securing member between the fixed position wherein the fixing member fixes the securing member in its secured position and the free position wherein the securing member is allowed to be displaced to its unsecured position.

16. The locking arrangement of claim 12, wherein the recess or opening in the body is provided by a third engagement formation, the securing member therefore engaging with the wall(s)/surface(s) of the third engagement formation defining the recess or opening, and wherein the locking arrangement is configured such that when the locking member is in its first or second locked position, the securing member is in register with the recess or opening of the third engagement formation, thereby allowing the securing member to extend into the recess or opening in order to secure the locking member releasably in its first or second locked position.

17. The locking arrangement of claim 12, wherein the first engagement formation is configured to be displaceable generally in a plane as the locking member is displaced towards, or away from, its first locked position, and the securing member is configured to be displaceable relative to the locking member along a securing path, which is oriented substantially parallel to the said plane, between its secured and unsecured positions.

18. A locking arrangement comprising:

a body;

a locking member which is displaceable in a plane relative to the body;

a securing mechanism including a securing member displaceable perpendicular to the plane relative to the locking member between a secured position and an unsecured position the securing mechanism including a biasing means which is configured to bias the securing member towards its secured position;

the securing mechanism further including a fixing member which is displaceable relative to the securing member between a fixed position wherein the fixing member fixes the securing member in its secured position and a free position wherein the securing member is allowed to be displaced to its unsecured position;

the fixing member connected to an actuator which includes a solenoid;

the solenoid configured to displace the fixing member out of engagement with the securing member from its fixed position towards its free position;

the fixing member connected to the actuator via a first order lever having a pivotal connection via which the lever is connected to the body;

the fixing member and actuator connected to the lever on opposite sides of the pivotal connection; and wherein the locking member includes angularly spaced recesses that receive the securing member therein, each recess having a tapered surface configured such that when the securing member is in its secured position in engagement with the recess, and the fixing member is displaced to its free position, and a force is applied to the locking member, the tapered surface functions in the manner of a cam surface to displace the securing member against the bias of the bias means to its unsecured position and thereby permit displacement of the locking member relative to the body.

* * * * *